US010062967B2

(12) United States Patent
Wunsch et al.

(10) Patent No.: US 10,062,967 B2
(45) Date of Patent: Aug. 28, 2018

(54) WIDE BAND ANTENNA HAVING A DRIVEN BOWTIE DIPOLE AND PARASITIC BOWTIE DIPOLE EMBEDDED WITHIN ARMOR PANEL

(71) Applicant: BAE SYSTEMS INFORMATION AND ELECTRONIC SYSTEMS INTEGRATION INC., Nashua, NH (US)

(72) Inventors: Gregory J. Wunsch, Milford, NH (US); William A. Spurgeon, Newark, DE (US); James P. Wolbert, Aberdeen, MD (US); James P. Zona, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 212 days.

(21) Appl. No.: 15/083,815

(22) Filed: Mar. 29, 2016

(65) Prior Publication Data

US 2016/0336657 A1 Nov. 17, 2016

Related U.S. Application Data

(63) Continuation-in-part of application No. 13/879,641, filed as application No. PCT/US2012/049093 on Aug. 1, 2012, now Pat. No. 9,300,053.

(60) Provisional application No. 61/522,751, filed on Aug. 12, 2011.

(51) Int. Cl.

| | |
|---|---|
| ***H01Q 1/32*** | (2006.01) |
| ***H01Q 9/28*** | (2006.01) |
| ***H01Q 1/40*** | (2006.01) |

(52) U.S. Cl.
CPC ..... *H01Q 9/28* (2013.01); *H01Q 1/3283* (2013.01); *H01Q 1/40* (2013.01)

(58) Field of Classification Search
CPC ..... H01Q 9/28; H01Q 1/32; H01Q 1/40
See application file for complete search history.

(56) References Cited

U.S. PATENT DOCUMENTS

| | | | | |
|---|---|---|---|---|
| 4,804,967 | A | 2/1989 | Ohe et al. | |
| 4,812,855 | A | 3/1989 | Coe et al. | |
| 5,444,453 | A | 8/1995 | Lalezari | |
| 6,333,719 | B1 * | 12/2001 | Varadan ..... | H01Q 1/364 333/161 |

(Continued)

*Primary Examiner* — Jessica Han
*Assistant Examiner* — Jae Kim
(74) *Attorney, Agent, or Firm* — Hayes Soloway; Davis & Bujold, PLLC

(57) ABSTRACT

A high powered armor panel having the wideband embedded antenna for operation in severe environmental conditions. The armor panel comprises a driven bowtie dipole electrically coupled to at least one driven resistor, a parasitic bowtie dipole electrically coupled to at least one parasitic resistor, a composite structure which has the driven bowtie dipole and the parasitic bowtie dipole embedded therein, a heat sink supported on a first side of the composite structure for dissipating heat, and an armor layer supported on an opposite second first side of the composite structure. The heat sink supports the at least one driven resistor electrically coupled to the driven bowtie dipole and the at least one parasitic resistor electrically coupled to the parasitic bowtie dipole.

17 Claims, 17 Drawing Sheets

(56) References Cited

U.S. PATENT DOCUMENTS

| | | | | |
|---|---|---|---|---|
| 6,833,815 | B2 | 12/2004 | Apostolos | |
| 7,170,440 | B1 | 1/2007 | Beckner | |
| 2004/0056801 | A1* | 3/2004 | Apostolos | H01Q 1/286 343/700 MS |
| 2005/0122269 | A1* | 6/2005 | Frazier | G01J 5/10 343/703 |
| 2008/0018545 | A1* | 1/2008 | Kaplan | H01Q 1/125 343/713 |
| 2011/0260935 | A1* | 10/2011 | Bortoin | F41H 5/02 343/713 |
| 2012/0154234 | A1* | 6/2012 | Geiler | H01Q 9/28 343/787 |
| 2012/0293380 | A1 | 11/2012 | Apostolos et al. | |
| 2012/0293381 | A1 | 11/2012 | Apostolos et al. | |

* cited by examiner

FIG. 15
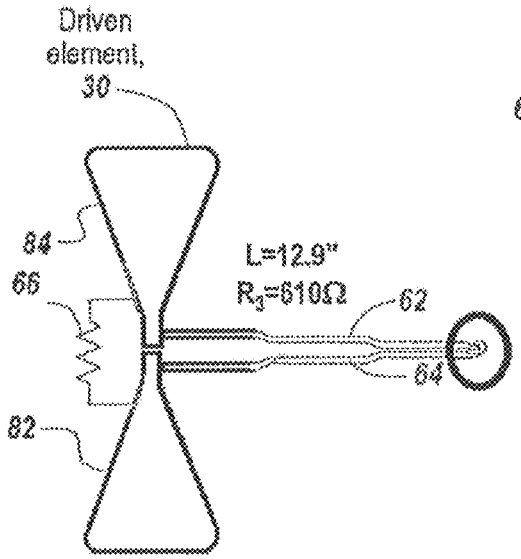
FIG. 15A
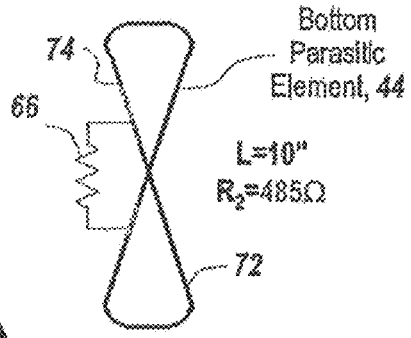
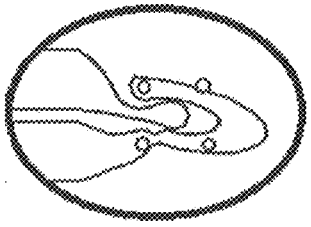
FIG. 15B

WIDE BAND ANTENNA HAVING A DRIVEN BOWTIE DIPOLE AND PARASITIC BOWTIE DIPOLE EMBEDDED WITHIN ARMOR PANEL

RELATED APPLICATIONS

This Application is a continuation-in-part of U.S. patent application Ser. No. 13/879,641 filed Apr. 16, 2013 which is a national stage completion of PCT/US2012/049093 filed Aug. 1, 2012 which claims the benefit of U.S. Patent Provisional Application Ser. No. 61/522,751 filed Aug. 12, 2011, and the contents of each of those applications are incorporated by reference herein in their entireties.

STATEMENT OF GOVERNMENT INTEREST

The invention was made with United States Government assistance under Contract No. W15P7T-09-C-S485 awarded by the US Army, as well as Contract No. W15P7T-10-C-A213 awarded by the US Army. The United States Government has certain rights in the invention.

FIELD OF THE INVENTION

This invention relates to an antenna utilized on armored vehicles and more particularly to an antenna system having an armor panel-embedded parasitically-fed antenna.

BACKGROUND OF THE INVENTION

As described in patent application Ser. No. 13/473,132 filed May 16, 2012 incorporated herein by reference, it is desirable to provide a thin structure for an antenna embedded in an armor panel and more particularly to provide a parasitic bowtie dipole on top of the armor layer so that when driving the antenna there are no apertures in the armor which would degrade performance. In one embodiment, the aperture-less embedded antenna system includes a direct fed dipole on the underneath side of the armor layer such that the armor layer is not pierced. There is an identical dipole on the top of the armor layer that is parasitically fed by the driven dipole. In one embodiment the dipoles are in the form of bowties.

As described in the above identified patent application, it is desirable to replace antennas such as whip antennas, conventionally attached extending from tanks, armored vehicles and the like, with broadband antennas that are conformal to an outer surface of the vehicle itself.

For example, having a forest of antennas that extend from the armored vehicle is undesirable because they are susceptible to damage and attack. It is therefore desirable to be able to provide an antenna system which is embedded within the armor so that the armor protects the embedded antenna both against explosive attacks and ballistic penetration. It is also desirable to eliminate the need for antenna whips, or similar configurations, which are easily damaged by explosive charges, thereby precluding communication with the vehicle.

It is noted that the thin structure of the prior art armor panels presents the greatest challenge to similar antenna design. Whether the panel is metal backed or is mounted on a metal vehicle, the close proximity of a conductive surface to a radiating bowtie dipole creates a ground plane that is too close to the bowtie dipole. As will be appreciated for traditional antenna design, the ground plane is spaced at least a quarter wavelength away from any driven bowtie dipole. However, when dealing with armor for vehicles, such as tanks, the spacing between the ground plane and the driven bowtie dipole of the antenna is on the order of hundredths of a wavelength.

While initially thought that this limitation would be a disqualifying factor in similar antenna designs, it has been shown that a thin antenna structure can be created which does not rely on deep cavities behind the bowtie dipoles. However, as described in the above patent applications, it has also been found that the close spacing, as well as other factors, disadvantageously limit bandwidth and gain. Indeed, this close spacing has also been found to result in non-optimal voltage standing wave ratios (herein after referred to as VSWR) across desired bandwidths, for instance between 225 MHZ and 450 MHZ.

Examples of these deep cavity structures are described in U.S. Pat. No. 6,833,815 which relates to Cavity Embedded Meanderline Loaded Antennas. In this patent, the antenna is described as a conformal antenna which is cavity-backed. According to one embodiment of this disclosure, a bowtie dipole is utilized, with the distal ends of the dipole being coupled to surrounding metal utilizing a meanderline structure.

The question becomes how one can better configure such dipole antenna into a thin structure for use with armor plates without disadvantageously limiting bandwidth and gain.

SUMMARY OF THE INVENTION

While a single parasitic/driver bowtie dipole combination has been used in a thin stacked bowtie dipole array as an embedded armor antenna, it has been found that the thin stacked bowtie dipole array achievable using a driven bowtie dipole on the inside of an alumina tile armor plate and a parasitic bowtie dipole on the outside of the armor plate can be improved in terms of horesight gain and VSWR by placing a bottom parasitic bowtie dipole between the driven bowtie and the body of the vehicle in which the driven antenna is embedded. Further improvement is achieved by spacing the bottom or inside parasitic antenna from the vehicle body to form an air gap.

In order to achieve satisfactory embedded antenna performance, in the subject invention bowtie dipoles are used both as the directly driven bowtie dipole and for both parasitically-driven bowtie dipoles. Moreover, along with the air gap each bowtie dipole is provided with a resistor between the bowtie dipoles, the values of which optimize antenna performance. Additionally, the lengths of the driven bowtie dipole and the parasitical bowtie dipoles are adjusted to maximize gain, minimize VSWR over a wide bandwidth and increase efficiency, with the gain at least −1, dBi over the entire bandwidth of the antenna, in one embodiment 225-450 MHZ.

In one embodiment, a plurality of armor embedded panels, each carrying the driven dipole and the two parasitically-driven bovine dipoles, are located side by side, for instance on a tank, and may driven in phase or may be phased to provide a sharp antenna lobe in a given direction. Thus, the gain in a particular direction may be increased with traditional antenna steering. As will be appreciated, for a steerable beam one can obtain increased gain in a particular pointing direction.

With a vertically polarized four panel array, the gain in the horizontal direction has been found to exceed −1 dBi across the entire bandwidth. It has also been found that with the dual parasitic bowtie dipoles and the air gap the VSWR across at least the 225-450 MHZ band can be made to be less than 3:1.

In summary, an extremely thin embedded antenna for an armor-carrying vehicle utilizes a dipole driven bowtie dipole to the inside of the armor plate and a pair of parasitically-driven bowtie dipoles to either side of the driven bowtie dipole, with the interior or back parasitic bowtie dipole and an air gap providing improved forward gain and antenna matching characteristics over the single parasitic bowtie dipole embedded antennas described in the above patent application.

It is an object of the present invention to provide an antenna system which can operate at a power of about 25 watts or more, and possibly as high as 100 watts or so, in order to improve the transmission range and reception range of the antenna system. This is accomplished by locating the resistors outside of the panel and on a heat sink located at the bottom (closest to the vehicle skin) of the panel, designed to efficiently dissipate and remove the heat generated by electrical current flowing in the metal and the resistors, thereby preventing overheating of the materials comprising the antenna panel.

Yet another objective of the present invention is to provide an antenna which can operate under extreme environmental conditions typically experienced by ground vehicles. This is accomplished by creating the antenna as a sealed panel as described in the following detailed description.

BRIEF DESCRIPTION OF THE DRAWINGS

These and other features of the subject invention will be better understood in connection with the Detailed Description, in conjunction with the Drawings, of which:

FIG. 15 is a diagrammatic illustration of an alternative driven bowtie dipole according to the present invention;

FIG. 15A is a diagrammatic illustration of the parasitic bowtie similar to that of FIG. 10A, showing the resistors between first and second halves of the parasitic bowtie dipole;

FIG. 15B is an enlarged drawing of area B of FIG. 15;

DETAILED DESCRIPTION

Prior to discussion of the specifics of the subject antenna system, it is noted that the thin structure of the armor panel is the greatest challenge to the panel with an embedded antenna design. Whether the panel is metal-backed, or is mounted on a metal vehicle, the close proximity of a conductive surface creates a ground plane to the radiating bowtie dipole. A conventional design would have the ground plane spaced at least a quarter-wavelength away. However, typically however, spacing available is more on the order of hundredths of a wavelength. In order to address an otherwise disqualifying factor in similar antenna designs, an armor embedded antenna was provided with an outside parasitic bowtie dipole. The present invention, including the first embodiment of an antenna embedded within an armor panel, is an improved modification of this design, and has at least one additional parasitically driven bowtie dipole.

Figure 1:
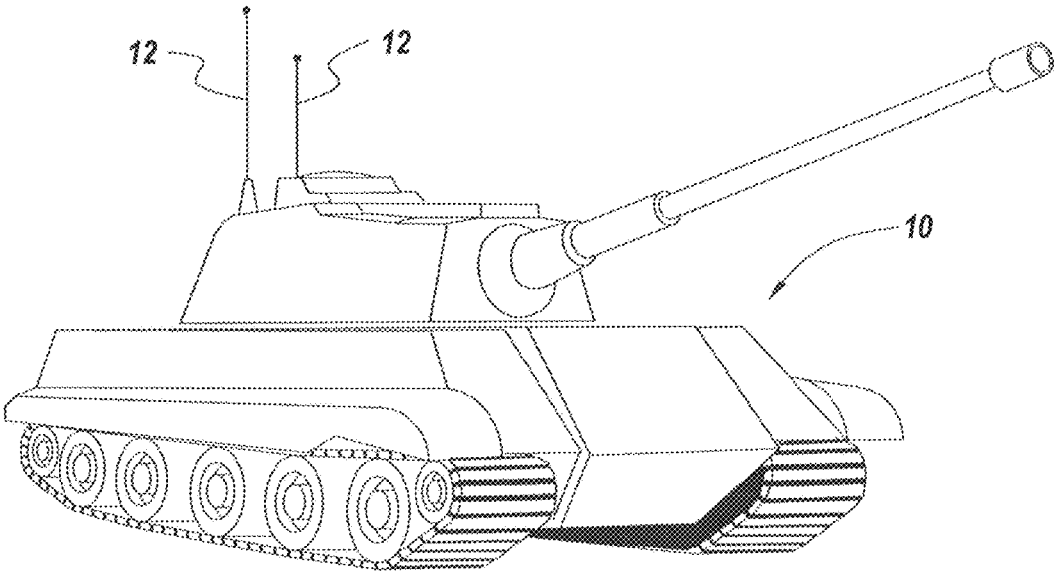
Fig. 1 (Prior Art)
FIG. 1 is a diagrammatic illustration of a tank sporting a pair of prior art whip antennas which are exceedingly vulnerable to enemy fire and which are subject to damage.

Referring now to FIG. 1, in the prior art, a tank 10 or other armored vehicle may be provided with a number of whip antennas 12 which extend above the vehicle and which are tuned to various frequency bands. The problem with such a configuration is that the whip antennas 12 are extremely vulnerable to destruction, e.g., by explosion, as well as being torn off the vehicle by overhead limbs and the like. Moreover, another disadvantage of this configuration is that there can be considerable cross talk or interference between these types of antennas.

It will be appreciated that in order to cover the frequency bands of interest, i.e., for communication with such a vehicle, a number of bands are required. Generally, it would be desirable to have communication antennas for such vehicles that operate throughout a 225 MHZ to 450 MHZ band. However, any antenna which currently has a sufficiently wide band width does not exist in any configuration other than a whip form.

Figure 2:
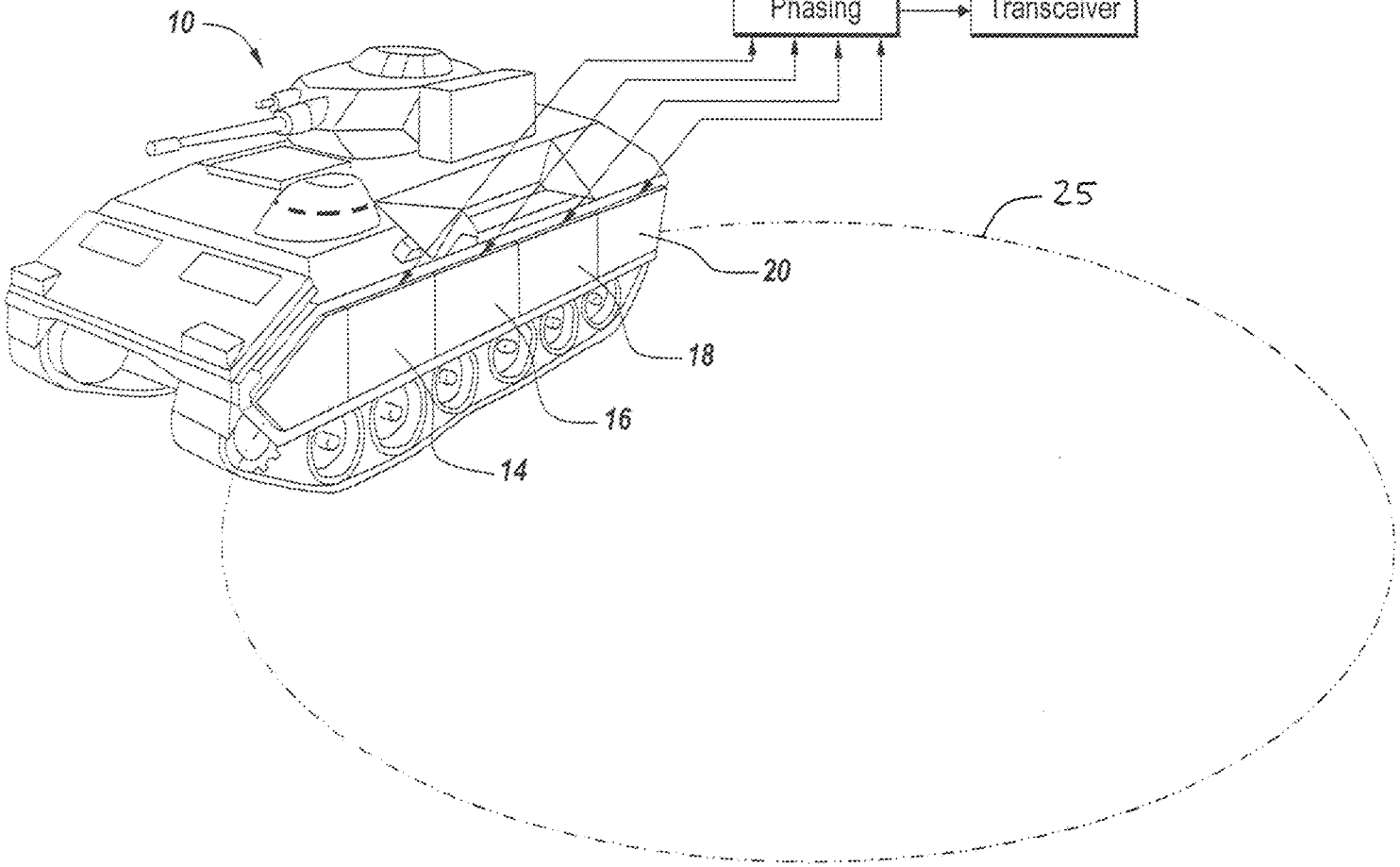
FIG. 2 is a diagrammatic illustration of the utilization of the subject embedded dipoles in a number of adjacent armor panels located on the side of a tank showing the ability to phase the embedded bowtie dipoles for directional purposes, with the bowtie dipoles when fed in parallel providing a 180° pattern to each side of the tank.

Referring now to FIG. 2, it is the purpose of the embodiment of the present invention to provide a conformal embedded antenna structure for vehicle 10 in which embedded antenna structures are provided in armor panel plates 14, 16, 18, 20. As shown here, when appropriately phased by a phasing network 22, these panel plates with embedded antenna 14, 16, 18, 20 result in an antenna lobe 25 has an 180 degree azimuthal coverage. Providing the tank 10 with embedded antenna plates on multiple sides provides 360 degree azimuthal coverage.

The antennas are capable of being used in a transmit mode and/or a receive mode. Thus, according to the present invention, a transmitter/transceiver 24 can listen for signals in 180 degrees about the horizon, and/or can transmit signals from the transmitter/transceiver 24 through the panel-embedded antennas with an antenna pattern such as that shown by reference numeral 25.

The challenge is to be able to provide a panel-embedded thin antenna structure that provides close to 180 degree coverage per side while also providing an ultra wideband coverage, as well as improved gain and efficiency.

Figure 3:
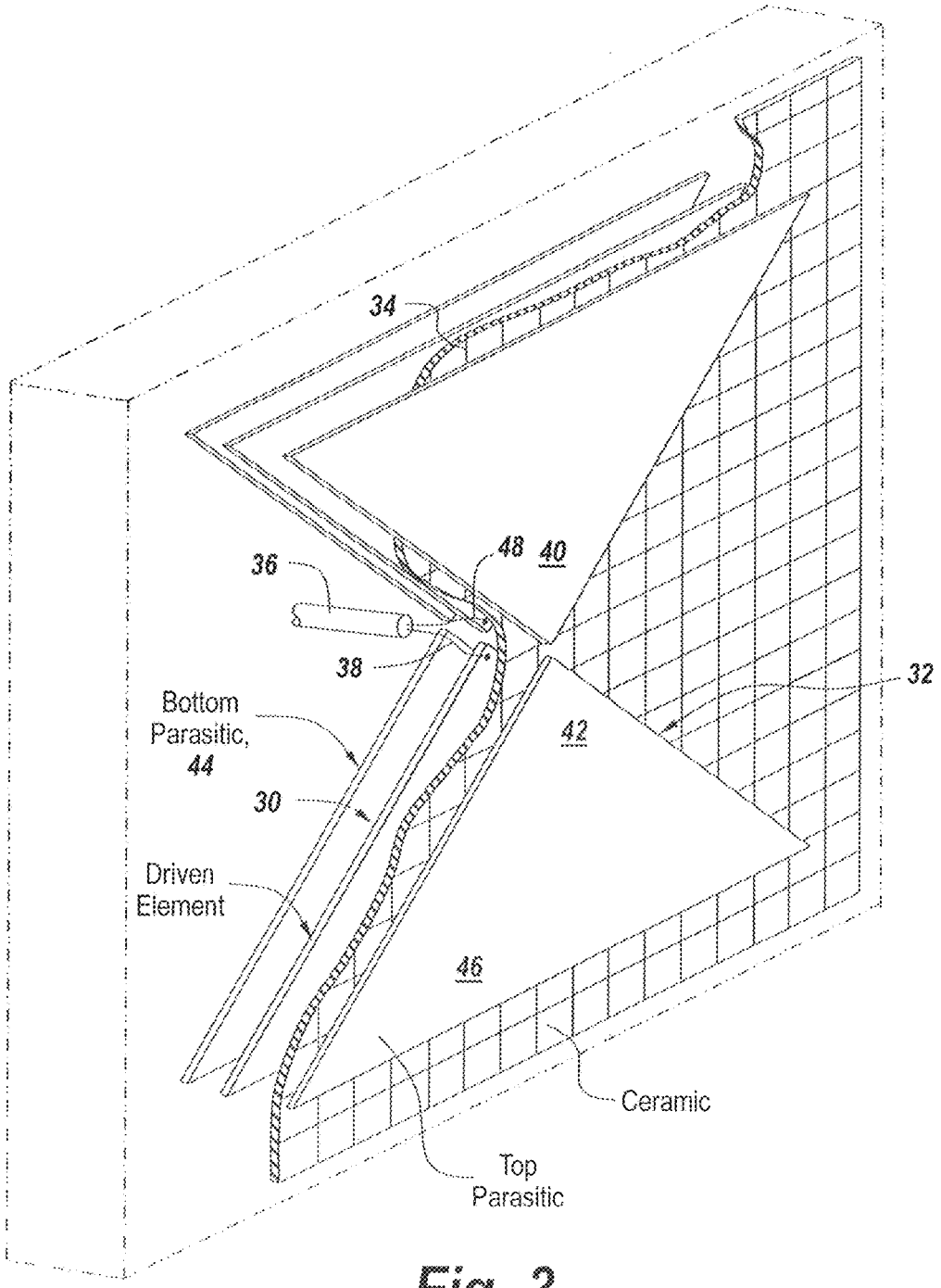
FIG. 3 is a diagrammatic illustration of one of the panels of FIG. 2 illustrating a driven bowtie dipole to the inside of a armor layer, with a parasitically-driven bowtie to the outside of the armor layer and a parasitically-driven bowtie between the driven bowtie dipole and a vehicle body.

In order to do so, and referring now to FIG. 3, a driven bowtie dipole 30 is surrounded by parasitic bowtie dipoles 32 and 44, with the bottom parasitic bowtie dipole improving the operation of the original antenna. Here a pair of dipoles 30 and 32 are located to either side of an alumina tile armor layer 34 such that the bowtie dipole 30 is driven by a transmission line 36 having conductors 38 and 48 which do not pierce the armor layer 34 tiles. The result is an unapertured armor layer in which energy is coupled to an inner bowtie dipole 30, without having to provide holes in the armor plate 34 of the panel 14, 16, 18, 20.

The top parasitic bowtie dipole 32 is parasitically driven by driven bowtie dipole 30 to provide a certain amount of gain. However, it was found that this gain could be improved by locating a bottom parasitic dipole 44 between driven bowtie dipole 30 and a surface of the vehicle 10, along with providing an air gap between the bottom parasitic dipole and the metallic vehicle body. It is noted that this air gap is still significantly thinner than the deep cavities used in the prior art, thereby overcoming several disadvantages of the prior art.

Figure 4:
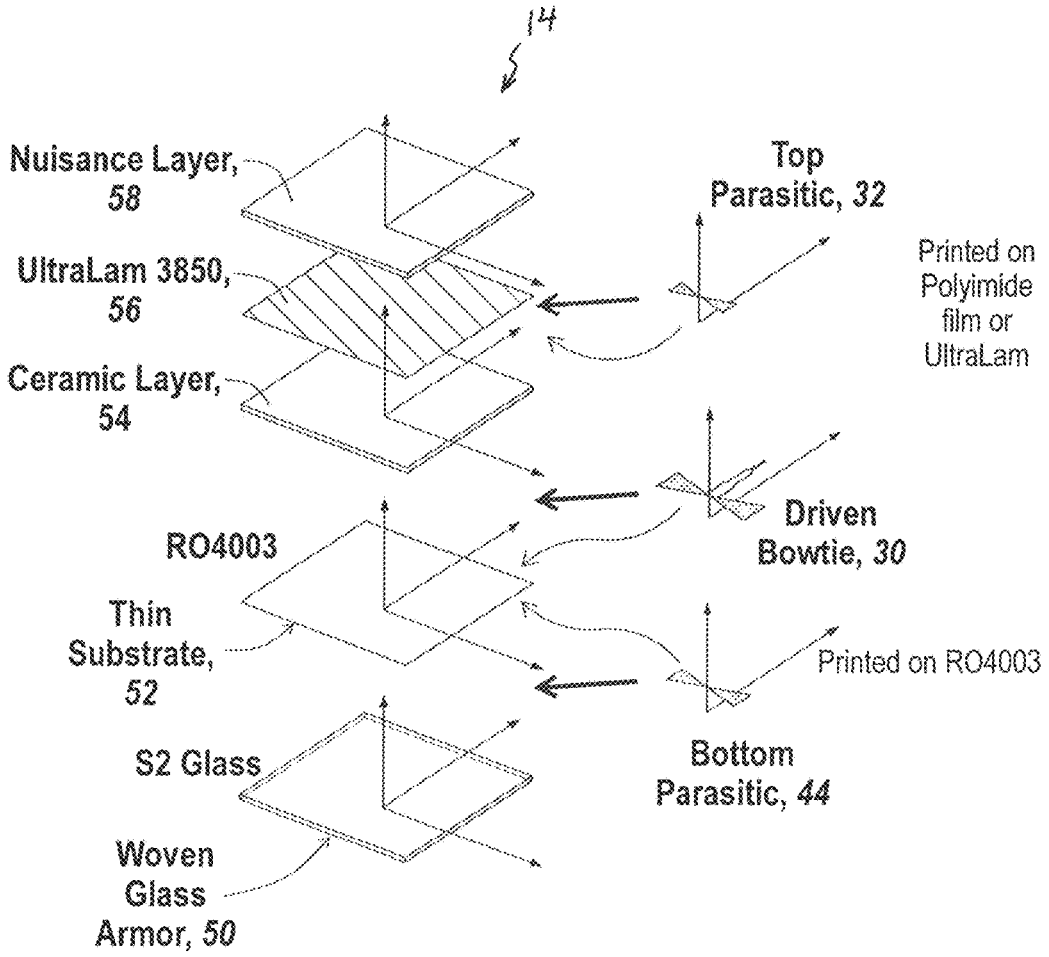
FIG. 4 is a diagrammatic illustration of the construction of the embedded armor antenna of FIG. 3.

Referring now to FIG. 4, the construction of the fused panel with an embedded driven dipole antenna, embedded top parasitic dipole antenna and embedded bottom parasitic dipole antenna is as follows. Going from base, i.e., the portion of the panel 14, 16, 18, 20 adjacent the surface of the vehicle, a layer of woven glass armor 50, typically S2 glass armor, has on an upper surface, a thin substrate 52, generally comprised of RO4003 material. Onto the side of the substrate 52 facing the glass armor 50 (bottom side as shown in FIG. 4), the bottom parasitic dipole 44 is patterned thereon. On an opposite side (top side as shown in FIG. 4) of the bottom parasitic dipole 44, the driven bowtie dipole is patterned on this thin substrate 52.

Adjacent the side of the substrate 52 having the driven dipole 30 is a ceramic layer 54 (top side of substrate 52 as shown in FIG. 4). On a top side of the ceramic layer 54, opposite the substrate 52, is a thin polymeric plastic material layer 56, such as UltraLain 3850 or a polyimide. The top parasitic bowtie dipole 32 is patterned on the underside of polymeric layer 56, adjacent the ceramic layer 54. Thereafter, a nuisance layer 58 is placed on top of the panel 14, 16, 18, 20 along an exterior surface of the polymeric layer 56.

Figure 5:
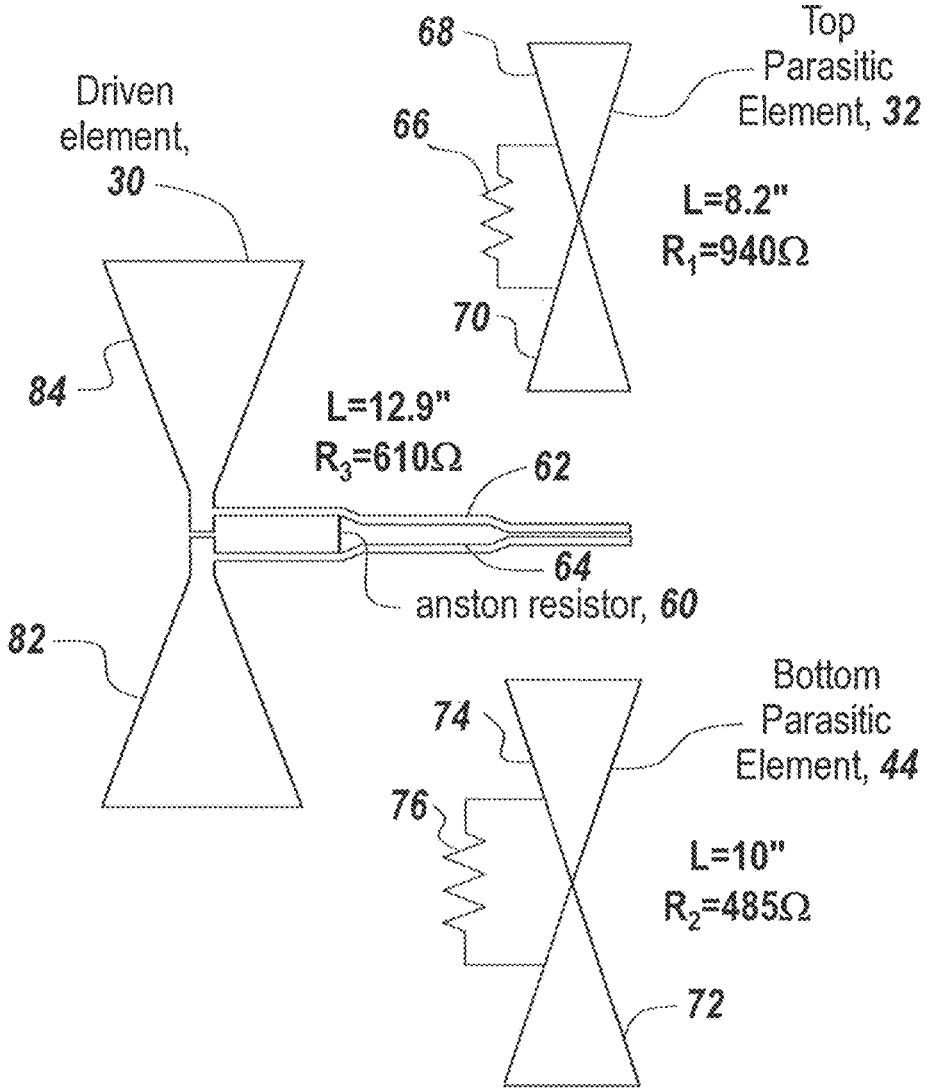
FIG. 5 is a diagrammatic illustration of the bowtie dipoles of the antenna of FIG. 3 showing critical dimensions and the use of resistors at the junctions of the bowtie dipoles.

Referring to FIG. 5, one configuration for the antenna of this embodiment, shows that the driven bowtie dipole 30, top parasitic bowtie dipole 32 and bottom parasitic bowtie dipole 44 are each provided with a respective resistor 66, 70, 76. Note that these resistor 66, 70, 76 can take the form of thin film resistors.

The driven bowtie dipole 30 is provided with a resistor 60 between the transmission lines 62 and 64 which lead to respective dipole halves 82, 84 of the driven bowtie dipole 30. The optimal performance values of the resistor 60 are a length of about 12.9 inches and a resistance R1 of about 610 ohms.

Referring to the bottom parasitic bowtie dipole 44, which has dipole halves 72 and 74 with a resistor 76 therebetween. The optimal length L2 of the bottom parasitic bowtie dipole is about 10 inches, whereas the optimal performance value of resistance R2 is about 485 ohms.

Top parasitic bowtie dipole 32 has a resistor 66 between bowtie dipole halves 68 and 70. The optimal performance values of the resistor 66 are a length L2 of about 8.2 inches and a resistance R2 of about 940 ohms.

Figure 6:
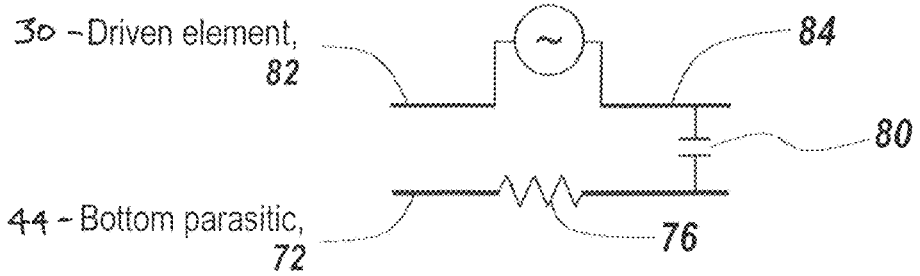
FIG. 6 is a schematic drawing showing the capacitance effect of the bottom parasitic bowtie dipole.

Referring to FIG. 6, which is a schematic diagram illustrating the effect of the above described configuration. Namely, by providing the bottom parasitic bowtie dipole 44 along with resistor 76, this has the effect of providing a capacitance coupling 80 between driven bowtie dipole 30 and dipole 44. The purpose of producing this capacitance effect is to lower the operating frequency of the antenna such that the bottom parasitic bowtie dipole 44 acts like an RC circuit to extend the lower band edge of the antenna down to 225 MHZ. This arrangement also has the effect of providing a VSWR of less than 3:1. Furthermore, by varying of the value of resistor 76 and the lengths of the bottom parasitic bowtie dipole 44, it is possible to vary the capacitance effect and thus optimize the VSWR and gain of the antenna. However, generally both the bottom parasitic bowtie dipole and top parasitic bowtie dipole are shorter than the driven bowtie dipole.

Figure 7:
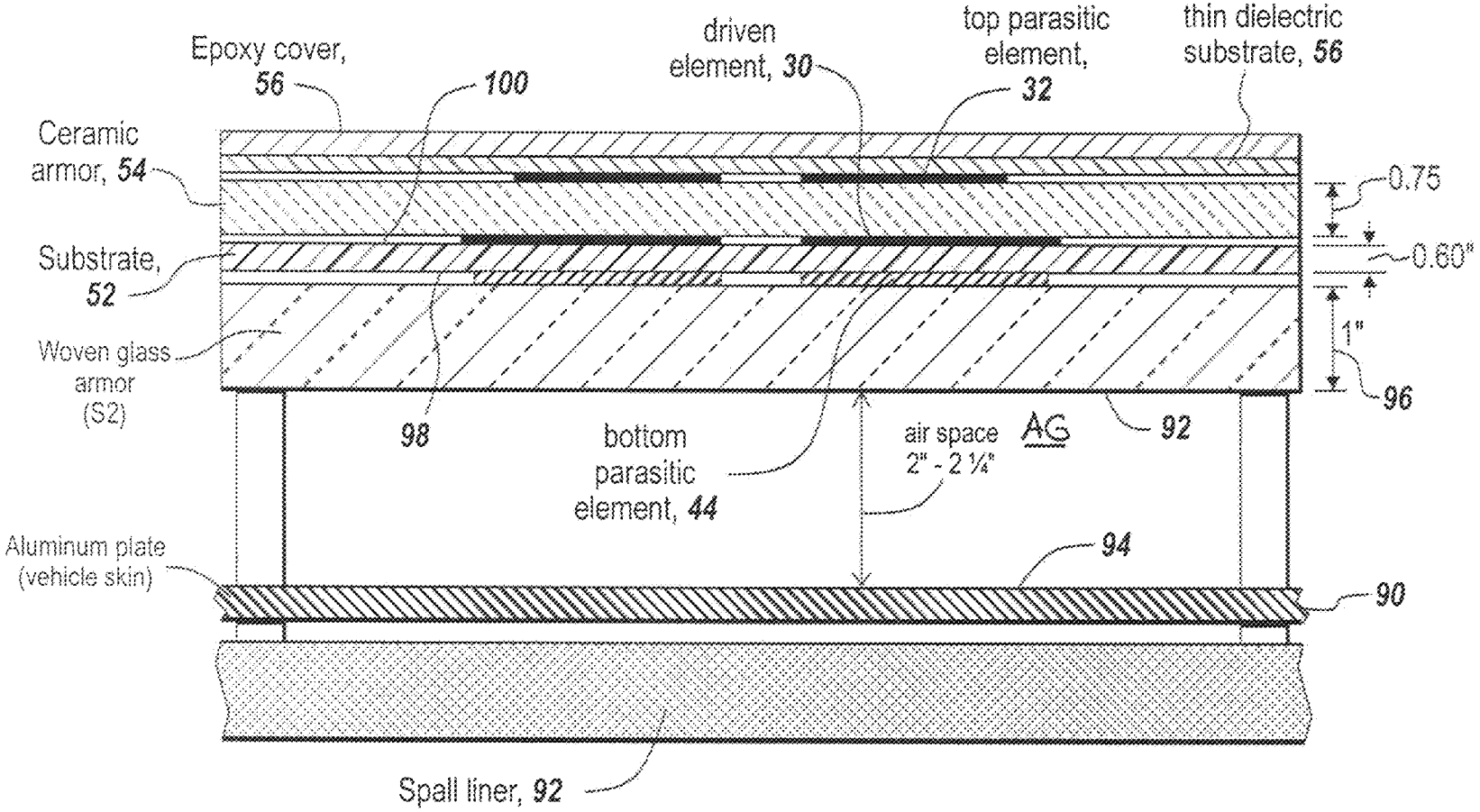
FIG. 7 is a cross sectional view of the embedded thin antenna of FIG. 3 illustrating not only a driven dipole and parasitically-driven dipoles, but also the air gap beneath the bottom parasitic bowtie dipole.

Referring now to FIG. 7, a cross section of the panel with embedded antenna 14 is illustrated in which the layers are built up from the surface of the vehicle body 10, in this case an aluminum plate 90, behind which a spall liner 92 is located. Woven glass S2 armor layer 50 of the panel 14 has an underside 92 which is spaced from the top side 94 of the aluminum plate ground plane 90 by an air gap AG of 2 inches to 2¼ inches. In addition to the capacitance effect described in FIG. 6, this air gap AG provides better isolation from the ground plane, and at the same time, improves gain and VSWR over a 2:1 bandwidth.

As illustrated by arrow 96, the thickness of the woven glass armor layer 50 is approximately 1 inch, with the bottom parasitic bowtie dipole 44 patterned onto the bottom surface 98 of substrate 52. In this embodiment the substrate 52 has a thickness of about 0.060 inches. Note, driven bowtie dipole 30 is patterned on the top surface 100 of this thin substrate 52.

Ceramic armor in the form of a ceramic armor layer 54 is positioned on top of the driven bowtie dipole 30 and in one embodiment has a thickness of about 0.75 inches. On top of the ceramic armor layer 54 is a thin dielectric substrate 56, with the top parasitic bowtie dipole 32 patterned on the underneath side of this substrate 56 facing the ceramic armor layer 54. Thereafter, a nuisance layer 58, here an epoxy cover, is placed on top to complete the armor panel with embedded antenna 14.

As mentioned hereinbefore, the prior art armor embedded antennas were not capable of providing an optimal bandwidth or VSWR, over the entire desired 225 MHZ to 450 MHZ band. The present invention provides a solution to this problem and other disadvantages over the prior art through several key features. First, providing the bottom parasitic bowtie dipole 44, which acts like an RC circuit to provide additional capacitance from the parasitic bowtie dipole 44 to the driven bowtie dipole 30. Second, placing resistors 60, 66, 76 at the junctions of the driven and parasitic bowtie dipoles. Third, adjusting the lengths of the parasitic bowtie dipoles 32, 44 with respect to the driven bowtie dipole 30 to change the capacitance and therefore optimize the VSWR and gain. Fourth further optimization was provided by the air gap AG to obtain additional separation from the ground plane for avoiding shorting of the antenna as well as avoiding poor impedance matching and poor bandwidth.

These features were found to provide several functional advantages over the prior art. The air gap AG increases ballistic penetration resistance with respect to the prior art embodiments. The gain throughout the bandwidth has been shown to be greater than −1 dBi, and is significantly better across the upper portion of the band. Thus, benefits of this embodiment include a better gain over the bandwidth, better VSWR and no deleterious effect on the ballistic characteristics of the antenna. Also note that utilizing bowtie configurations provides an additional advantageous feature over the prior art by broadening of the bandwidth because impedance does not markedly change with frequency.

Figure 8:
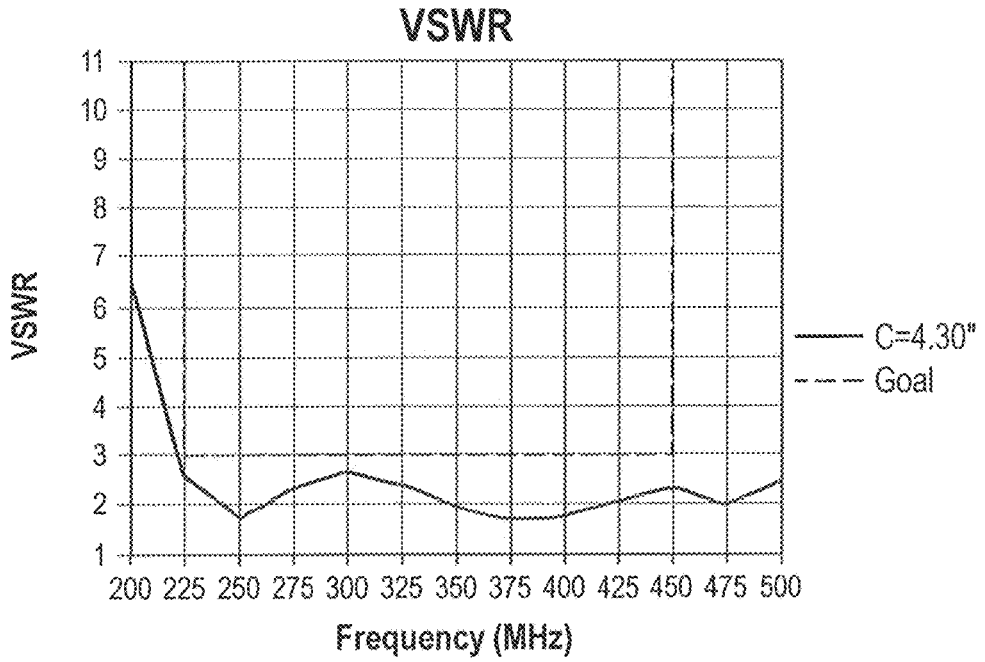
FIG. 8 is a graph showing VSWR for the antenna of FIG. 3.
Figure 9:
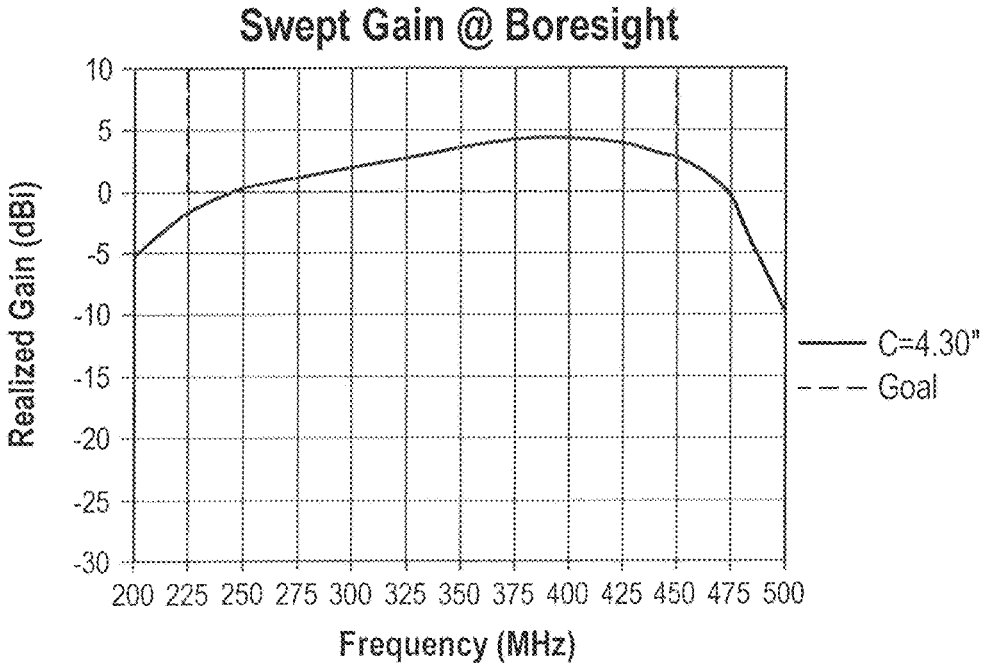
FIG. 9 graphs gain vs. frequency for the antenna of FIG. 3.

The above advantages in operation are confirmed in FIGS. 8 and 9. FIG. 8 provides a graph in which VSWR is shown against frequency. Note that the dotted line indicates the goal of having the VSWR under 3:1, with the diagram illustrating that the average VSWR of the prior art is around 2:1.

Referring to FIG. 9, what is shown is a graph of the swept gain at the boresight versus frequency, with the goal being better than 0 dBi gain. Here it can be seen that the gain for the subject antenna at the low end is above −1 dBi and is considerably above 0 dBi for the remainder of the bandwidth.

Turning now to FIGS. 10-15, a "high" powered embodiment of the present invention will now be described. As this embodiment is similar to the previously discussed embodiment, only the differences between this new embodiment and the previous embodiment will be discussed in detail while identical elements will be given identical reference numerals.

Figure 10:
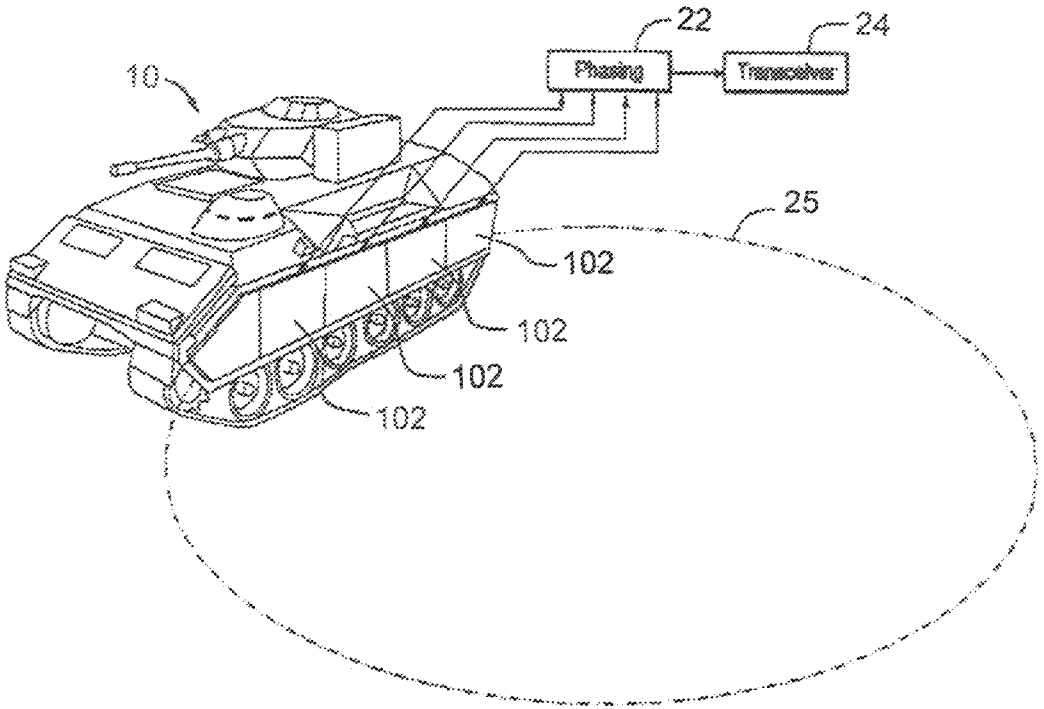
FIG. 10 is a diagrammatic illustration of the utilization and phasing of multiple plates consisting of a high powered version of the panel with embedded antenna according to the present invention.

According to these embodiments, as shown in FIG. 10, the antenna system 100 is designed to operate at a much higher power level, i.e., operate at a power level of at least 10 watts and more preferably at about 25 watts or more and possibly operate as high as 100 watts or so. Due to higher operating power, the system 100 of panels with embedded antennas 102 has a greater range but will also generate much more heat than the previous embodiment. The inventors have determined that such additional heat must be suitably managed, e.g., removed, from the panel with embedded antenna 102 in order to avoid catastrophic failure and/or possible disintegration of a portion, e.g., the resistors, of the panel with embedded antenna 102. Advantageously, the panel with embedded antenna 102 is designed with a fused panel configuration which facilitates withstanding severe environmental conditions, e.g., heat, cold, sand, dust, rain, etc.

The present invention utilizes relatively thicker layers of copper than previously used in printed circuit boards, which advantageously facilitates operating the panel with embedded antenna 102 in excessive heat and other severe environmental conditions. These thicker layers of copper are then soldered to 10 gauge copper wire routing outside of the armor panel, to where the resistors are relocated, on a surface of a heat sink 140. This arrangement of the present embodiment facilitates conduction of the heat generated inside of the panel 102 to ambient air located outside of the panel and along an air gap AG. In this embodiment of the invention, the copper layers are generally more than 20 times thicker than that of otherwise similar prior art printed circuit board metallized layers, e.g., prior art layers are generally less than 0.0015 inches thick. Preferably, in the higher power embodiment according to the present invention, the copper whets are generally at least 0.030 of an inch thick and can be as thick as 0.125 of an inch, or thicker as necessary to accommodate the higher power levels according to the present invention. These thicker layers of copper are arranged in correspondingly sized pockets 130, 115 machined in the S2 glass laminate substrate material 112, 126 in order to reduce an overall thickness of the armor panel 102 (see for example, FIG. 10E and related cross-sections in FIGS. 12-12C).

With respect to the high powered second embodiment, similar to the panel with embedded antenna 14 of the previous embodiment, one or more armored plates with an embedded antenna 102 may be applied to a tank or some other armored vehicle 10. By itself, a single panel of the high powered second embodiment, generates an antenna lobe 25 which typically has approximately 180 degree coverage in azimuth. Accordingly, by providing the tank or other armored vehicle 10 with two or more armor plates each having an embedded antenna 102 on all (four) sides of the tank or other armored vehicle 10, a system of panels 100 can be made. When appropriately combined, such system 100 of panels with an embedded antenna 102 is able to provide 360 degrees of coverage in azimuth. Furthermore, a combination of panels with an embedded antenna 102 according to the high powered second embodiment can also be phased by a phasing network 22, thus resulting in higher gain directional antenna lobes 25 which can be focused and/or steered in different directions.

The armor plates with the embedded antenna 102 are capable of being used in both a transmit mode and a receive mode such that a transceiver/transmitter 24 can listen for signals in the configured azimuth range, about the horizon and/or can transmit signals from the transmitter/transceiver 24 in a desired pattern 25. As with the previous embodiment, the challenge is to be able to provide a thin panel-embedded antenna structure that provides substantially 180° coverage per side and yet has an ultra wideband coverage characteristic and improved gain and efficiency while still maintaining an appropriate form factor for vehicle mounting.

In this embodiment, similar to the previous embodiment, a driven bowtie dipole 30 is utilized. However, according to this embodiment, only a single (bottom) parasitic bowtie dipole 44, also in the form of a bowtie dipole, is required. This bottom parasitic bowtie dipole 44 cooperates with the driven bowtie dipole 30 to improve operation of the antenna overall. As with the previous embodiments, the driven bowtie dipole 30 and bottom parasitic bowtie dipole 44 are both located inwardly with respect to an outwardly facing armor layer 54. This advantageously ensures that the driven bowtie dipole 30 can be driven via the transmission line conductors 38 and 48 of the transmission conductor line 36 without piercing the outwardly facing armor layer 54 which prevents any apertures, openings or other imperfections from forming in the armor layer 54.

As with the previous embodiment, the bottom parasitic bowtie dipole 44 is parasitically driven by the driven bowtie dipole 30 to provide a certain amount of gain. The bottom parasitic bowtie dipole 44 is still located between the driven bowtie dipole 30 and an exterior surface of the vehicle 10 such that an air gap AG, e.g., typically between 2 and 2½ inches, is located between the bottom parasitic dipole 44 and a metallic exterior surface of the body of the armored vehicle 10.

Figure 10A:
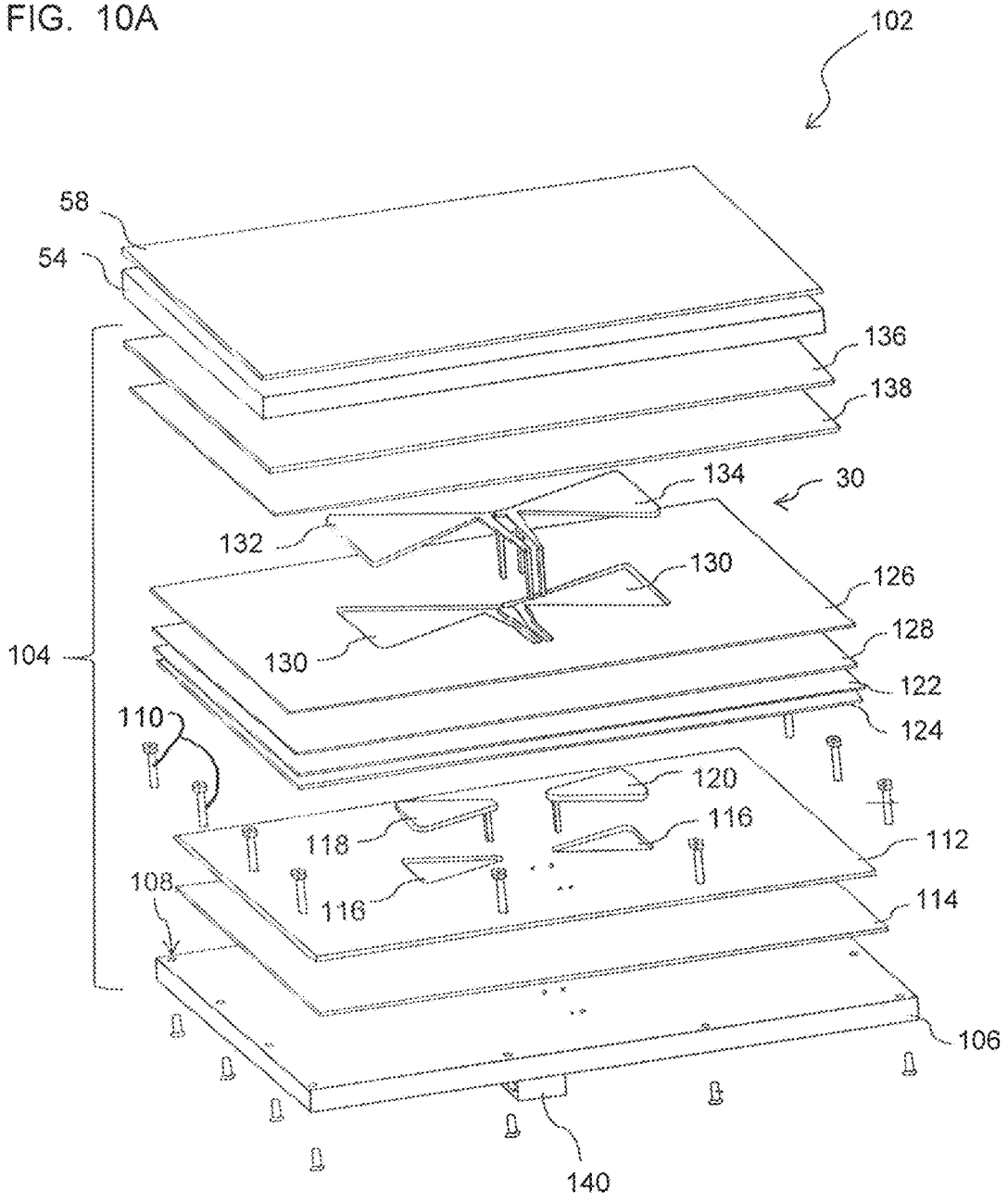
FIG. 10A is an exploded perspective view showing assembly of the various layers for forming a high powered version of the panel with embedded antenna according to the present invention.

With particular reference now to FIG. 10A, as shown, the structure for accommodating the driven bowtie dipole 30 and the bottom parasitic bowtie dipole 44 comprises a relatively thick inwardly facing base composite glass structure 104. This base composite glass structure 104 is typically about 1 inch+½ inch thick and generally comprises five separate and distinct glass layers 106, 112, 122, 126, 136, plus a variety of intermediate adhesive layers 114, 124, 128, 138. The glass layers 106, 112, 122, 126, 136 and the adhesive layers 114, 124, 128, 138 are assembled, as discussed below in further detail, and permanently secured to one another via a conventional autoclave process.

A relatively thick layer of ceramic armor 54 is permanently secured to a top surface of the composite glass structure 104, that is an outer surface of the composite glass structure 104. This layer of ceramic armor 54 is typically about ¾ of an inch+½ inch thick. However, its thickness can vary depending upon the amount of armor protection desired for the particular application.

Lastly, a relatively thin exterior nuisance layer 58 is permanently secured onto an outwardly facing top surface of the ceramic armor 54. This nuisance layer 58 typically has a thickness of about 0.032+0.005 inch and generally comprises S2 glass or polyimide. During use and operation of the panel with embedded antenna 102, the exterior nuisance layer 58 protects the panel 102 from being damaged due by the external environment, e.g., scratches from flying gravel, debris, etc.

As shown here in FIG. 10A, a first base layer of S2 glass 106 is typically relatively thick, e.g., a thickness of about 0.860+0.500 of an inch. As shown, the peripheral edges of the base first layer of S2 glass 106 are provided with a plurality of spaced apart through holes 108 which are each sized to receive a respective fastener 110, such as a bolt or screw, which facilitates fastening of the panel with the embedded antenna 102 to a desired tank or some other armored vehicle.

A relatively thin second layer of S2 glass 112 (typically about 0.032+0.005 of an inch) is secured to a top surface of the base first layer of S2 glass 106 by a first adhesive layer 114, e.g., typically a thin coating, layer, or sheet of a. B-stage adhesive. As shown in FIG. 10A, the second layer of S2 glass 112 has a pair of cavities 116 formed therein and the pair of cavities 116 each have a size and a shape that closely mirrors, but is slightly larger in size than an exterior profile of one of the first and the second halves 118, 120 of the bottom parasitic bowtie dipole 44. The bottom parasitic bowtie dipole 44 has a thickness that is either the same thickness as the second layer of S2 glass 112, or has a thickness which is slightly less, e.g., a few thousands of an inch or so, than the thickness of the second layer of S2 glass 112.

As a result of this arrangement, once the second layer of S2 glass 112 is located on the top surface of the first layer of S2 glass 106, the first and the second halves 118, 120 of the bottom parasitic bowtie dipole 44 can then be closely accommodated and received within a respective one of the pair of cavities 116 in the second layer of S2 glass 112. It is to appreciated that the thickness of the bottom parasitic bowtie dipole 44 must be either precisely the same as, or slightly less than, the thickness of the second layer of the S2 glass so as to minimize the possibility of any cracks and other imperfections from forming within the composite glass structure 104 or the panel with embedded antenna 102.

A relatively thicker third layer of S2 glass 122 (typically about 0.063+0.010 of an inch) is secured to a top surface of the second layer of S2 glass 112 by a second adhesive layer 124, e.g., typically a thin coating, layer, or sheet of a B-stage adhesive. This second adhesive layer 124 is applied over the top surface of the second layer of S2 glass 112 as well as over the bottom parasitic bowtie dipole 44. Next, a relatively thin fourth layer of S2 glass 126 (typically shout 0.032+0.005 of an inch) is secured to a top surface of the third layer of S2 glass 122 by a third adhesive layer 128, e.g., again, typically a thin coating, layer, or sheet of a B-stage adhesive. The fourth layer of S2 glass 126, similar to the second layer of S2 glass 112, has a pair of cavities 130 formed therein. In this instance, however, the pair of cavities 130 each have a sized and shaped which closely mirrors, but is slightly larger in size than an exterior profile of the driven bowtie dipole 30.

In addition, the driven bowtie dipole 30 has a thickness that is precisely the same thickness as the thickness of the fourth layer of S2 glass 126, or a thickness that is slightly less, e.g., by a few thousands of an inch or so, than the thickness of the fourth layer of S2 glass 126. As a result of this arrangement, once the fourth layer of S2 glass 126 is secured to the top surface of the third layer of S2 glass 122, the first and the second halves 132, 134 of the driven bowtie dipole 30 can then be closely accommodated and received within a respective one of the pair of cavities 130 of the fourth layer of S2 glass 126. It is to appreciated that the thickness of the driven bowtie dipole 30 must being either the same as, or slightly less than, the thickness of the fourth layer of S2 glass 126 so as to minimize the possibility of any cracks and other imperfections from forming within the composite glass structure 104 or the panel with embedded antenna 102.

Finally, a relatively thin cover fifth layer of S2 glass 136 (typically about 0.018+0.005 of an inch) is secured to a top surface of the fourth layer of S2 glass 126 by a fourth adhesive layer 138, e.g., also typically a thin coating, layer, or sheet of a B-stage adhesive. This fourth adhesive layer 138 is applied on the top surface of the fourth layer of S2 glass 126 as well as over the driven bowtie dipole 30 in order to complete formation of the base composite glass structure 104. As noted above, the ceramic armor 54 and the nuisance layer 58 are then applied thereto in a conventional manner.

Following assembly of the glass layers and the adhesive layers, these components of the base composite glass structure 104 are then permanently bonded to one another by a conventional autoclave process, for example. Thereafter, the heat sink 140 and the resistors 50, 76 are attached to the armor panel to complete fabrication of the armor panel with the embedded antenna 102. The fasteners 110 can then be utilized to attach the panel with the embedded antenna 102 to a tank or some other armored vehicle 10. In order to facilitate access to these fasteners 110 after assembly of the panel with the embedded antenna 102, the overall width and lengths of the top and intermediate layers 112, 122, 126 136, 54 and 58 are each slightly smaller than the overall width and length of the base first glass layer 106, as shown in FIGS. 11, 11A and 11B for example.

Figure 11:
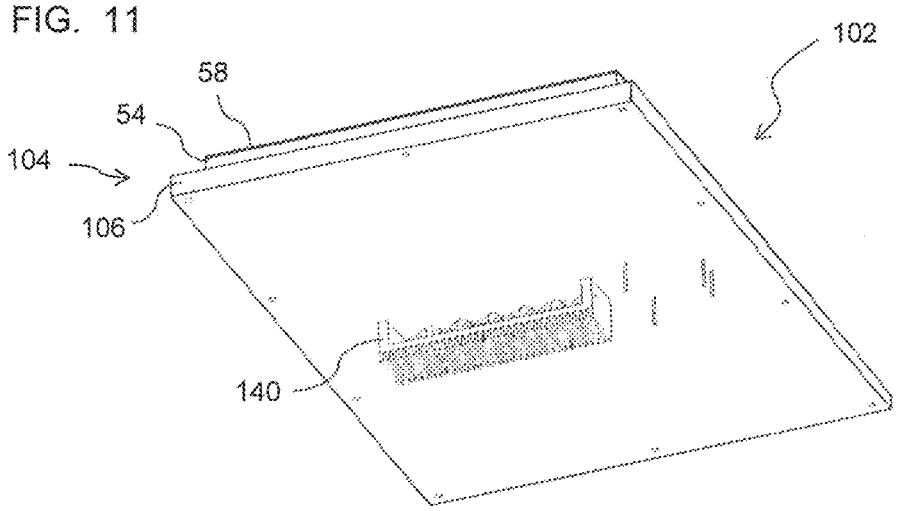
FIG. 11 is a left, bottom, rear perspective view of one embodiment of the assembled high powered version of the panel with the embedded antenna according to the present invention.
Figure 11A:
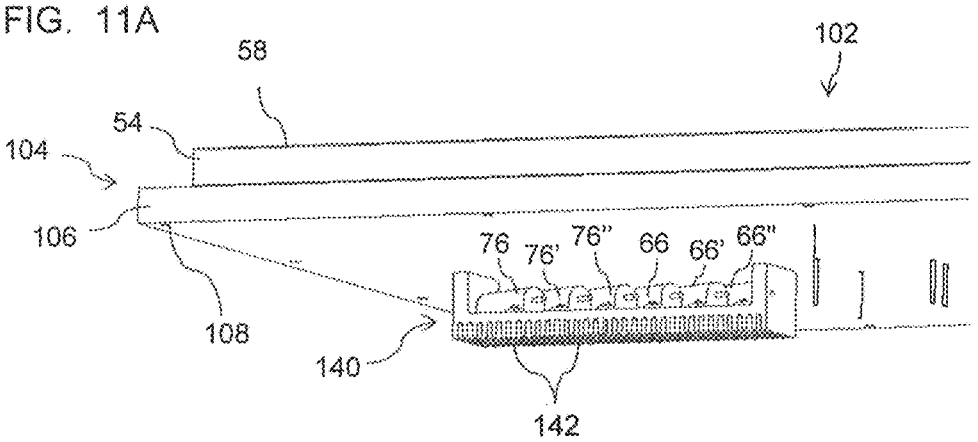
FIG. 11A is an enlarged partial left, bottom perspective view of the assembled high powered version of the panel of FIG. 11.
Figure 11B:
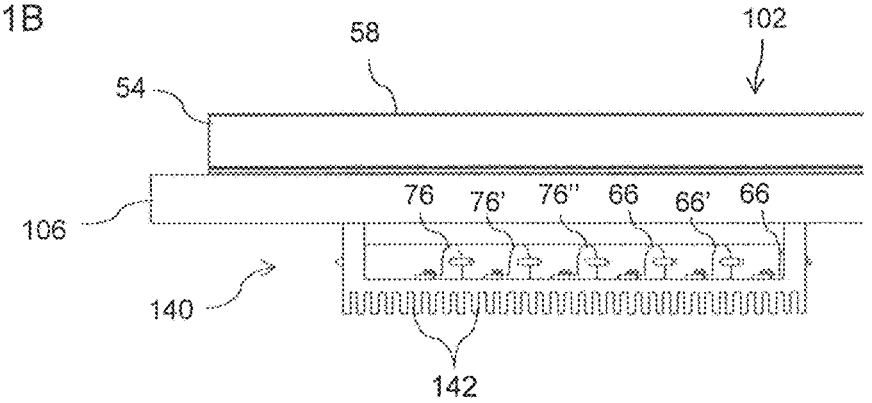
FIG. 11B is a partial left side elevational view of the assembled high powered version of the panel of FIG. 11.

As also shown in FIGS. 11-11B, the heat sink 140 is U-shaped and is permanently secured to an inwardly facing bottom surface of the base first layer of S2 glass 106 of the composite glass structure 104 in order to facilitate dissipating heat generated by the resistors 60, 76. The U-shaped heat sink 140 is typically manufactured from a high thermally conductive material, in this case aluminum to prevent corrosion, and typically has a length of between 9 and 15 inches, a width of approximately 3 inches and a height of approximately 1 inch.

Enlarged views in FIGS. 11A and 11B show that the inwardly facing first surface of the heat sink 140 is provided with a plurality of parallel fins 142. These parallel fins 142 extend parallel to one another and into the air gap AG, that is, away from the heat sink 140 and towards the surface of the vehicle 10. The plurality of parallel fins 142 are designed to provide additional surface area and thus facilitates dissipation of the heat generated by the driven bowtie dipole 30 and the parasitic bowtie dipole 44.

An opposed outwardly facing second surface of the heat sink 140, facing toward the composite glass structure 104, supports both 1) at least one resistor 60 which is electrically coupled to the driven bowtie dipole 30, and 2) at least one resistor 76 which is electrically coupled to the bottom parasitic bowtie dipole 44. The heat sink 140 is designed to sufficiently space the resistors 60, 76 away from the base first layer of S2 glass 106 of the composite glass structure 104 while also preventing the plurality of fins 142, carried by the inwardly facing first surface of the heat sink 140, from directly contacting or engaging with the (aluminum plate) vehicle skin of the armored vehicle 10.

Due to such arrangement and following installation of the panel with embedded antenna 102 on a tank or some other armored vehicle 10, the heat sink 140 is generally located within the air gap AG formed between the panel with the embedded antenna 102 and an exterior surface of the metallic body of the vehicle 10. The air contained within the air gap AG is thus able to flow freely around and over with the heat sink 140 and the plurality of fins 142 and thereby efficiently dissipate and remove the heat from the heat sink 140, generated by the resistors 60, 76, and prevent overheating of the panel with the embedded antenna 102. The heat sink 140 is very effective in removing heat from the resistors 60, 76 and this facilitates use of the panel with the embedded antenna 102 in extremely hot environments, e.g., deserts and other hot climates.

Figure 12:
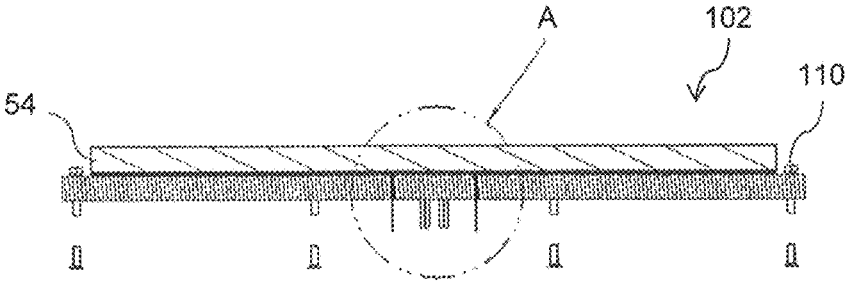
FIG. 12 is a diagrammatic cross sectional view of a panel with the embedded antenna of FIG. 10A, prior to assembly of the heat sink and resistors.
Figure 12A:
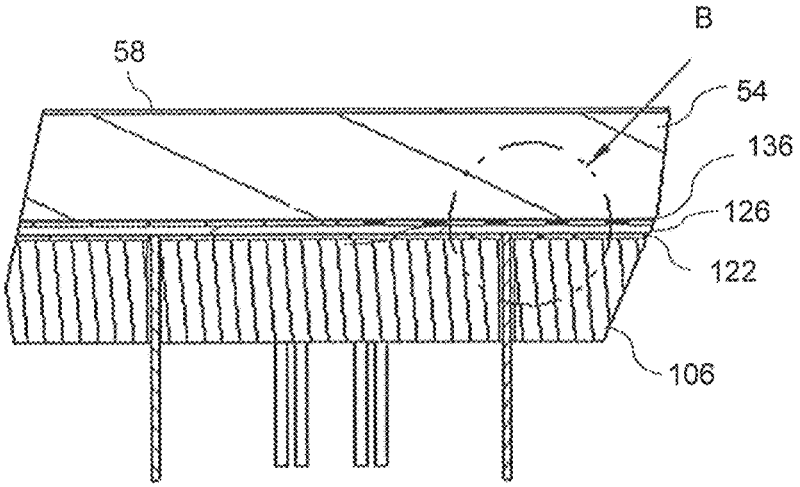
FIG. 12A is an enlarged sectional view of area A of FIG. 12.
Figure 12B:
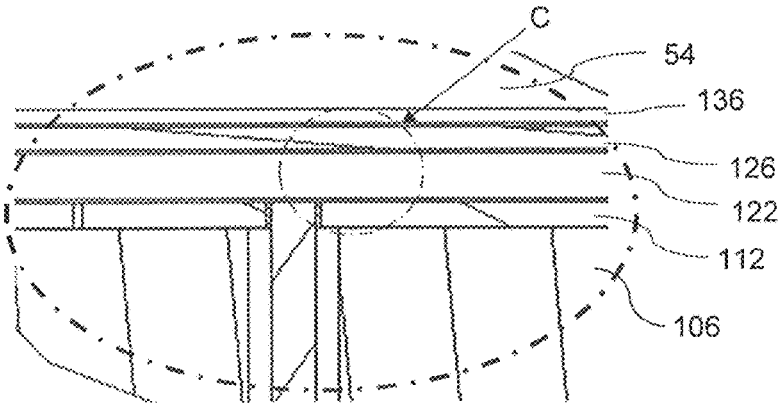
FIG. 12B is an enlarged sectional view of area B of FIG. 12A.
Figure 12C:
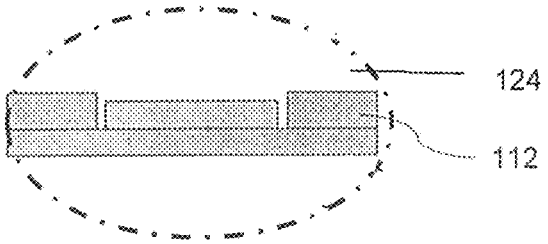
FIG. 12C is an enlarged diagrammatic cross sectional view of FIG. 12B showing the pocket and accommodated bowtie dipole.

FIG. 12 is a diagrammatic cross sectional view of the panel with the embedded antenna, prior to assembly of the heat sink 140 and resistors 66, 76. An enlarged portion of FIG. 12 is shown in FIG. 12A illustrating the relative sizes of the composite base layer 104 and the ceramic layer 54. A portion of FIG. 12A is again enlarged in FIG. 12B to illustrate the connection of the connectors through the glass layer 112 while remaining external to the glass layer 136. A portion of FIG. 12B is enlarged in FIG. 12C to illustrate the thicker layers of copper of the driven bowtie dipole 30 arranged in a correspondingly sized pocket 130 which is machined in the S2 glass laminate substrate material layer 126.

It is important that the pair of cavities 116, 130, for both the driven bowtie dipole 30 and the bottom parasitic bowtie dipole 44, closely accommodate each one of the respective bowtie halves 118, 120 or 132, 134 so as to prevent any tilting or movement of the bowtie halves 118, 120 or 132, 134 within the respective cavities 116 or 130 following assembly and during use of the panel with the embedded antenna 102. In addition, it is also important that the transmission lines 62 and 64 (see FIG. 15), for the first and the second halves 132, 134 of the driven bowtie dipole 30, have very high tolerances and always remain precisely arranged parallel one another in order to maintain the desired electrical performance of the panel with the embedded antenna 102. The pair of cavities 130 for the first and second halves 132, 134 of the driven bowtie dipole 30 assist with maintaining the transmission lines 62, 64 parallel one another.

Figure 13:
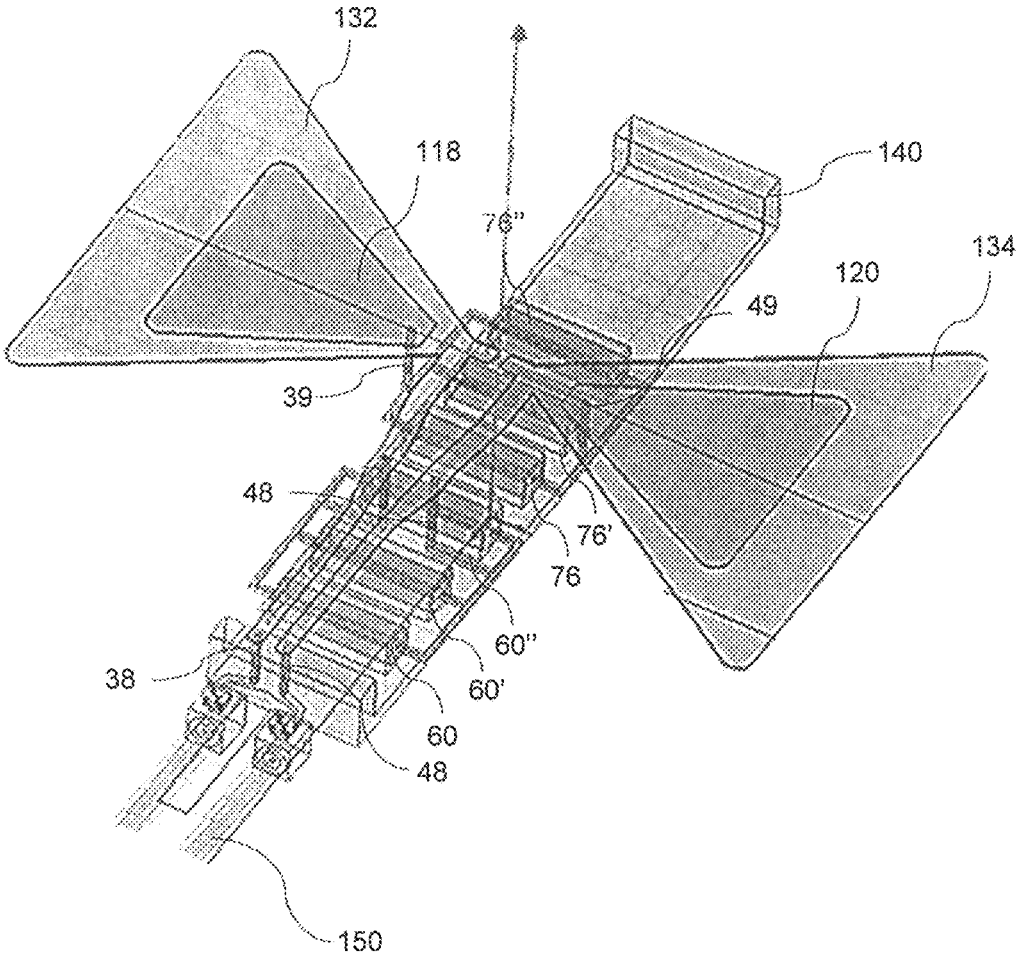
FIG. 13 is a diagrammatic perspective view illustrating the interrelationship and arrangement of the various components with one another, with the layers removed to facilitate understanding
Figure 14:
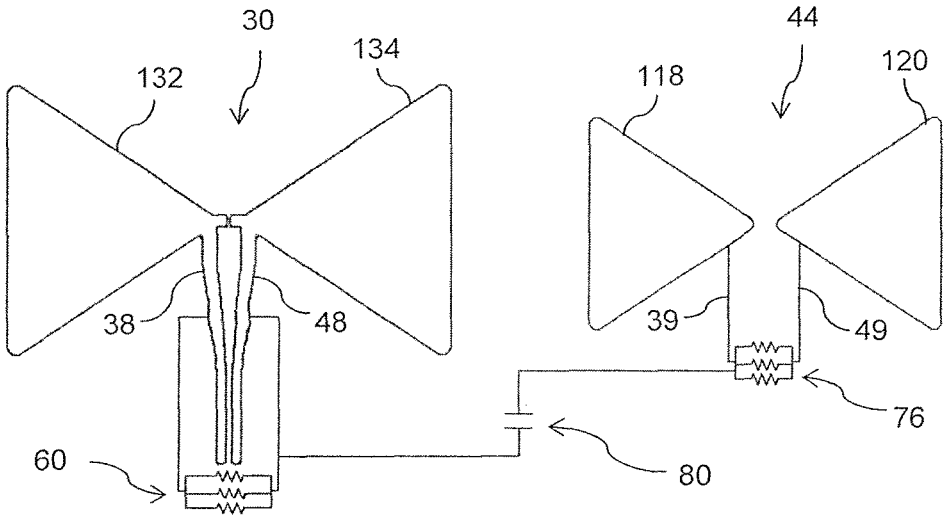
FIG. 14 is a diagrammatic top plan view showing the modified design of the driven bowtie dipole with the use of resistors according to the present invention.
Figure 14A:
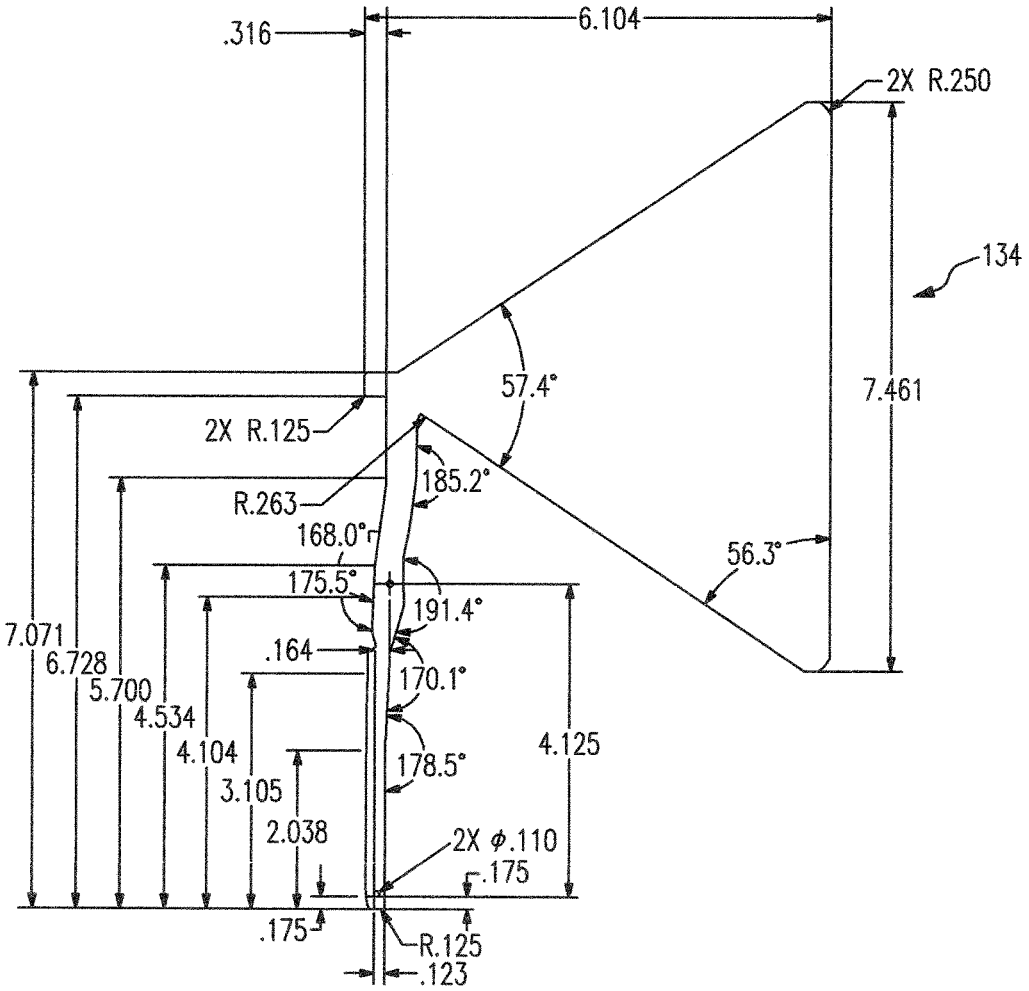
FIG. 14A illustrates the dimensions of the first half of the driven bowtie dipole of FIG. 14.

FIG. 13 illustrates a diagrammatic top plan view of a modified design of the driven bowtie dipole 30 and parasitic bowtie dipole 44 interacting with the resistors 76 and heat sink 140 according to the present invention. As with the previous embodiment, each one of the driven bowtie dipole 30 and the bottom parasitic bowtie dipole 44 comprises at least one resistor 76 which is respectively provided with a resistance value that optimizes performance of the panel with the embedded antenna 102.

If desired, the single resistor 60 of the driven bowtie dipole 30 can be replaced with two or more separate resistors 60, 60', 60", etc., which are arranged in parallel with one another, so that the two or more resistors 60, 60', 60', etc., still provide the desired resistance between the first half 132 and the second half 134 of the driven bowtie dipole 30. It is to be appreciated that the use of two or more resistors 60, 60', 60", etc., assist with dissipating the heat generated by the resistors 60, 60', 60", etc., over a greater surface area of the heat sink 140 and thereby assist with more efficient cooling of the panel with the embedded antenna 102.

In addition, the single resistor 76 of the bottom parasitic bowtie dipole 44 can be replaced with two or more resistors 76, 76', 76", etc., arranged in parallel with one another, so that the two or more resistors 76, 76', 76", etc., still provide the desired resistance between the first half 118 and the second half 120 of the bottom parasitic bowtie dipole 44. It is to be appreciated that the use of two or more resistors 76, 76', 76", etc., assist with dissipating the heat generated by the resistors 76, 76', 76", etc., over a greater surface area of the heat sink 140 and thereby assist with more efficient cooling of the panel with embedded antenna 102.

As generally shown in FIGS. 13-15B, the single resistor 60 for the driven bowtie dipole 30 is replaced with three separate resistors 60, 60', 60", each having a resistance of roughly 1200 ohms. In FIG. 13, resistors 60, 60', 60" are each arranged in parallel to one another so that the three resistors 60, 60', 60", each provide the total resistance of about 400 ohms, between the first half 132 and the second half 134 of the driven bowtie dipole 30. As also generally shown, the single resistor 76, for the bottom parasitic bowtie dipole 44 is replaced with three separate resistors 76, 76', 76", Each resistor 76, 76', 76" has a resistance of about 900 ohms. As shown here, these resistors 76, 76', 76" are arranged in parallel to one another so that the three resistors 76, 76', 76" provide a total resistance of about 300 ohms, between the first half 118 and the second half 120 of the bottom parasitic bowtie dipole 44.

A first driven conductor passes through the base first layer of S2 glass 106, the first bonding layer 114, the second layer of S2 glass 112, the second bonding layer 124, the third layer of S2 glass 122, and the third bonding layer 128 and electrically connects a first side of the parallel circuit, of the plurality of resistors 60, 60', 60", etc., for the driven bowtie dipole 30, with the first half 132 of the driven bowtie dipole 30. A second driven conductor passes through the base first layer of S2 glass 106, the first bonding layer 114, the second layer of S2 glass 112, the second bonding layer 124, the third layer of S2 glass 122, and the third bonding layer 128 and electrically connects an opposed second side of the parallel circuit, of the plurality of resistors 60, 60', 60", etc., for the driven bowtie dipole 30, with the second half 134 of the driven bowtie dipole 30.

A first parasitic conductor 39 passes through the base first layer of S2 glass 106 and the first bonding layer 114 and electrically connects a first side of the parallel circuit, of the plurality of resistors 76, 76', 76", etc., with the first half 118 of the bottom parasitic bowtie dipole 44. A second parasitic conductor 49 passes through the base first layer of S2 glass 106 and the first bonding layer 114 and electrically connects an opposed second side of the parallel circuit, of the plurality of resistors 76, 76', 76", etc., with the second half 120 of the bottom parasitic bowtie dipole 44. As shown in FIG. 10A, the base first layer of S2 glass 106, and possibly the first bonding layer 114, and may be provided with preformed holes which facilitate passing the first and the second parasitic conductors 39, 49 therethrough for connecting the resistors 76, 76', 76", etc., to the first and the second halves 118, 120 of the bottom parasitic bowtie dipole 44.

A first transmission line conductor 38 passes through the base first layer of S2 glass 106, the first bonding layer, the second layer of S2 glass 112, the second bonding layer, the third layer of S2 glass 122, and the third bonding layer and electrically connects the first half 132 of the driven bowtie dipole 30 to a first end of the balun 150. A second transmission line conductor 48 passes through the base first layer of S2 glass 106, the first bonding layer, the second layer of S2 glass 112, the second bonding layer, the third layer of S2 glass 122, and the third bonding layer and electrically connects the second half 134 of the driven bowtie dipole 30 to a second end of the balun 150. The balun facilitates connection of the panel with embedded antenna 102 with the transceiver 24 to provide to transmit power and signals to and from the panel with embedded antenna 102 in a conventional manner.

As noted above, following installation of the panel with the embedded antenna 102 on a tank or some other armored vehicle 10, an air gap AG is formed between the inwardly facing bottom surface of the composite glass structure 104 and the metallic body of the vehicle 10. The air contained within the air gap AG is readily able to flow into and out of this air gap AG and sufficiently cool the heat sink 140 and the resistors 60, 60', 60", etc., 76, 76', 76", etc.

The optimal length of the bottom parasitic bowtie dipole 44 is 10 inches, whereas the value of resistor 76 is typically 485 ohms. As with the previous embodiment, the net effect of providing the bottom parasitic bowtie dipole along with resistor 76 is a capacitance coupling 80 between driven bowtie dipole 30 and the parasitic bowtie dipoles 44. The purpose of this capacitance effect is to lower the operating frequency of the antenna such that the parasitic bowtie dipole on the bottom acts like an RC circuit to extend the lower band edge of the antenna down to 225 MHZ while, at the same time, keeping the panel a short distance from the vehicle skin (a few hundredths of a wavelength). The capacitance counteracts the inductive environment of the metallic skin of the vehicle and enables the antenna panel to achieve a VSWR less than 3:1, while simultaneously maintaining a realized gain of −1 dBi or above throughout the 225 to 450 MHZ bandwidth. The area of the bottom parasitic bowtie dipole governs the value of capacitance.

Further dimensions are generally shown in diagrammatic FIG. 15, while FIG. 15A and diagrammatically illustrate distinctions between the driven bowtie dipole 30 and the bottom parasitic bowtie dipole 44. For example, the length of the bottom parasitic bowtie dipole 44 is typically shorter than the length of the driven bowtie dipole 30. However, FIGS. 15A and 15B also diagrammatically illustrate similarities of the driven bowtie dipole 30 and the bottom parasitic bowtie dipole 44. Each of the corner region of the first and the second bowtie halves 118, 120 and 132, 134, of both the driven bowtie dipole 30 and the bottom parasitic bowtie dipole 44, are round, e.g., they have a radius of curvature of approximately 0.25 inches or so. The radius of curvature of the bowtie dipole halves 118, 120, 132, 134 are designed to relieve stresses that may occur in the corner regions of the bowtie(s) and thereby prevent fatigue and/or structural failure of either substrate or one of the bowtie dipoles during operation and/or use of the panel with embedded antenna 102.

It is noted that by variation of the value of resistor 76 and the area of the bottom parasitic bowtie dipole one can vary the capacitance effect and thus optimize the VSWR and gain of the antenna.

In a typical application, an inwardly facing surface of panel is spaced from an outwardly facing surface or side 94 of the aluminum plate ground plane by a distance of 2 inches to 2¼ inches. It has been found that in addition to the capacitance effect described in FIG. 6, the air gap AG or air space provides better isolation from a ground plane and, at the same time improving gain and VSWR over a 2:1 bandwidth.

It was found that the antenna of the first embodiment, while operational, had room for improvement. For example, it was found that the benefits derived from providing a top parasitic bowtie dipole were outweighed by the disadvantages in increased finished panel size. Furthermore, by eliminating the top parasitic bowtie dipole, the associated manufacturing time and cost are reduced.

As mentioned previously, the prior art armor embedded antennas were not capable of providing an optimal bandwidth or VSWR over the entire desired 225 MHz to 450 MHz band. The high power embodiment of the second embodiment provides all of the advantages over the prior art of the previous embodiments, in addition to several further functional key features.

In addition to the previous advantages, the present embodiments simultaneously tremendously increase the power rating of the panel with the embedded antenna 102. As previously stated, the thin structure of the armor panel is the greatest challenge to the antenna design, and the present embodiments provide overall conformal panel designs which reduce vulnerability to destruction compared to the whip configurations, e.g., by explosion, as well as being torn off the vehicle by overhead limbs and the like. Moreover, another advantage of the present configurations are the reduction of considerable cross talk or interference between the antennas when compared with the prior art. Furthermore, the increased power rating and composite structure provides further advantages over the prior art for ruggedizing the antenna to withstand severe environmental conditions and otherwise strengthen the panel for better resistance to wear, stress, and abuse.

Figure 16:
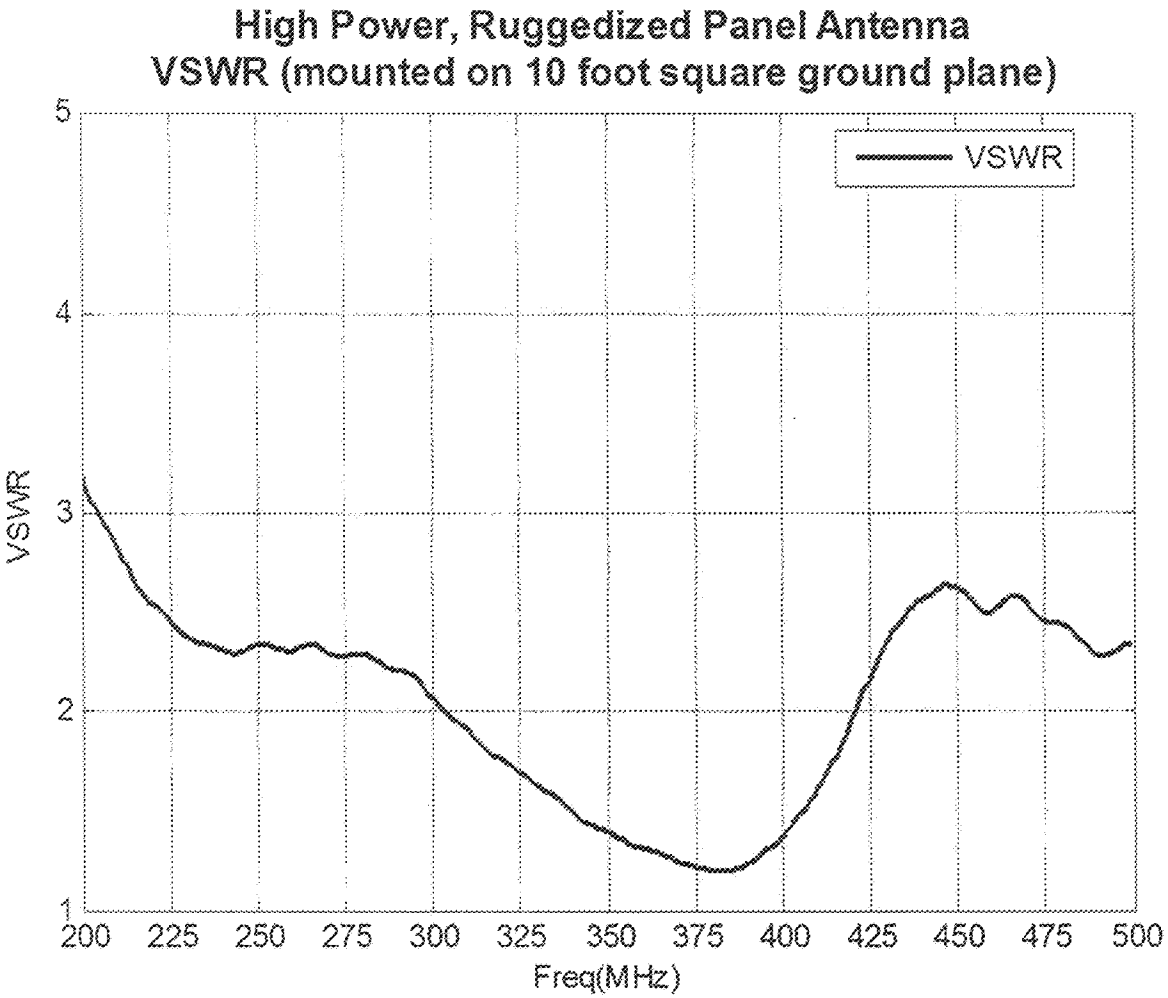
FIG. 16 is a graph showing VSWR, illustrating that the VSWR for the antenna of FIG. 10A can be kept to under 3:1 from 225 MHZ-450 MHZ.

The above operation is confirmed in FIG. 16 in which VSWR is graphed against frequency. Note that the dotted line indicates the goal of having the VSWR under 3:1, with the diagram illustrating that the average VSWR is around 2:1.

Figure 17:
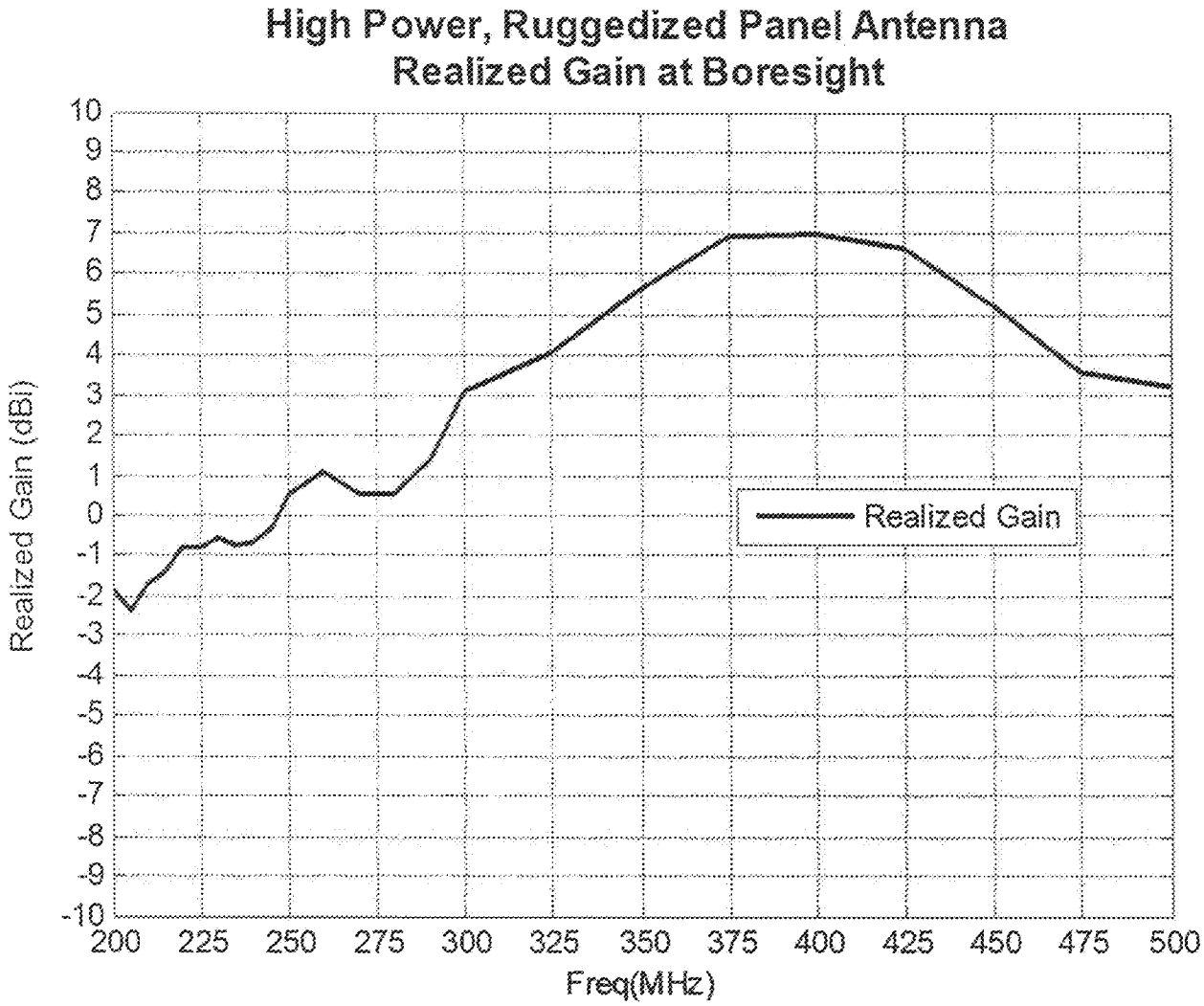
FIG. 17 is a graph showing boresight gain versus frequency for the antenna of FIG. 10A.

FIG. 17 is a graph of the swept gain at the boresight versus frequency, with the goal being better than 0 dBi gain. Here it can be seen that the gain for the antenna, according to the second embodiment of the present invention, at the low end is above −1 dBi and is considerably above 0 dBi for the remainder of the bandwidth.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A high powered armor panel having a wideband embedded antenna, the armor panel comprising:

a driven bowtie dipole electrically coupled to at least one driven resistor; a parasitic bowtie dipole electrically coupled to at least one parasitic resistor;

a composite structure having the driven bowtie dipole and the parasitic bowtie dipole embedded therein;

wherein the composite structure comprises a base first layer, a second layer of the composite structure has a pair of cavities which are sized and shaped to receive and closely accommodate the parasitic bowtie dipole, a fourth layer of the composite structure has a pair of cavities which are sized and shaped to receive and closely accommodate the driven bowtie dipole, and a third layer of the composite structure separates the driven bowtie dipole from the parasitic bowtie dipole;

a heat sink supported on a first side of the composite structure for dissipating heat from the driven bowtie and the parasitic bowtie dipole; and an armor layer supported on an opposite second first side of the composite structure.

2. The high powered armor panel having the wideband embedded antenna according to claim 1, wherein the heat sink supports the at least one driven resistor electrically coupled to the driven bowtie dipole and the at least one parasitic resistor electrically coupled to the parasitic bowtie dipole.

3. The high powered armor panel having the wideband embedded antenna according to claim 1, wherein corner regions of first and second dipoles of both the driven bowtie dipole and the parasitic bowtie dipole are round so as to relieve stress that may occur in the corner regions of the dipole and prevent fatigue during operation and use.

4. The high powered armor panel having the wideband embedded antenna according to claim 1, wherein the wideband embedded antenna operates at a power level of between 10 watts to 100 watts.

5. The high powered armor panel having the wideband embedded antenna according to claim 1, wherein the wideband embedded antenna operates at a power of about 25 watts.

6. The high powered armor panel having the wideband embedded antenna according to claim 1, wherein both the parasitic bowtie dipole and driven bowtie dipole are manufactured from a sheet of a metallic sheet.

7. The high powered armor panel having the wideband embedded antenna according to claim 1, wherein both the parasitic bowtie dipole and driven bowtie dipole are manufactured from a copper sheet which has a thickness of between 0.030 to 0.125 thousands of an inch.

8. The high powered armor panel having the wideband embedded antenna according to claim 1, wherein a nuisance layer is permanently secured to an outwardly facing top surface of the armor layer.

9. The high powered armor panel having the wideband embedded antenna according to claim 1, wherein a thickness of the parasitic bowtie dipole is equal to or less than a thickness of the second layer while a thickness of the driven bowtie dipole is equal to or less than a thickness of the fourth layer.

10. The high powered armor panel having the wideband embedded antenna according to claim 1, wherein first and second driven conductors having a thickness of between 0.030 and 0.125 of an inch pass through the base first layer, the second layer and the third layer and electrically connect the driven resistor to the driven bowtie dipole: and first and second parasitic conductors having a thickness of between 0.030 and 0.125 of an inch pass through at least, the base first layer and electrically connect the parasitic resistor to the parasitic bowtie dipole.

11. The high powered armor panel having the wideband embedded antenna according to claim 1, wherein peripheral edges of a base first layer of the composite structure are provided with a plurality of spaced apart through holes for receiving a respective fastener to facilitate fastening of the armor panel to a desired vehicle.

12. The high powered armor panel having the wideband embedded antenna according to claim 1, wherein the driven bowtie dipole operates in a UHF band which ranges from 225 MHZ to 450 MHZ.

13. The high powered armor panel having the wideband embedded antenna according to claim 1, wherein the at least one driven resistor comprises a plurality of driven resistors which provide a total resistance of 400 ohms while the at least one parasitic resistor comprises a plurality of driven resistors which provide a total resistance of 300 ohms.

14. The high powered armor panel having the wideband embedded antenna according to claim 1, wherein the driven bowtie dipole has a length of about 12.9 inches while the parasitic bowtie dipole has a length of about 8.2 inches.

15. The high powered armor panel having the wideband embedded antenna according to claim 1, wherein an air gap of between 2 and 2¼ inches spaces the second parasitically driven bowtie dipole front a metallic skin of an armored vehicle.

16. An armored vehicle having at least two high powered armor panels each having a wideband embedded antenna, the each one of the at least two armor panels comprising:

a driven bowtie dipole electrically coupled to at least one driven resistor;

a parasitic bowtie dipole electrically coupled to at least one parasitic resistor;

a composite structure having the driven bowtie dipole and the parasitic bowtie dipole embedded therein;

wherein the composite structure comprises a base first layer, a second layer of the composite structure has a pair of cavities which are sized and shaped to receive and closely accommodate the parasitic bowtie dipole, a fourth layer of the composite structure has a pair of cavities which are sized and shaped to receive and closely accommodate the driven bowtie dipole, and a third layer of the composite structure separates the driven bowtie dipole from the parasitic bowtie dipole;

a heat sink supported on a first side of the composite structure for dissipating heat from the driven bowtie and the parasitic bowtie dipole;

an armor layer supported on an opposite second first side of the composite structure;

and the heat sink supporting the at least one driven resistor electrically coupled to the driven bowtie dipole and the at least one parasitic resistor electrically coupled to the parasitic bowtie dipole.

17. A method of forming a high powered armor panel having a wideband embedded antenna, the method comprising:

electrically coupling a driven bowtie dipole to at least one driven resistor;

electrically coupling a parasitic bowtie dipole to at least one parasitic resistor;

embedding the driven bowtie dipole and the parasitic bowtie dipole in a composite structure;

wherein the composite structure comprises a base first layer, a second layer of the composite structure has a pair of cavities which are sized and shaped to receive and closely accommodate the parasitic bowtie dipole, a fourth layer of the composite structure has a pair of cavities which are sized and shaped to receive and closely accommodate the driven bowtie dipole, and a third layer of the composite structure separates the driven bowtie dipole from the parasitic bowtie dipole;

supporting a heat sink on a first side of the composite structure for dissipating heat from the driven bowtie and the parasitic bowtie dipole;

supporting the at least one driven resistor electrically coupled to the driven bowtie dipole and the at least one parasitic resistor electrically coupled to the parasitic bowtie dipole on the heat sink; and supporting an armor layer on an opposite second first side of the composite structure.

* * * * *